US011560659B2

(12) United States Patent
Chae et al.

(10) Patent No.: US 11,560,659 B2
(45) Date of Patent: Jan. 24, 2023

(54) WASHING MACHINE AND CONTROL METHOD OF SAME

(71) Applicant: LG Electronics Inc., Seoul (KR)

(72) Inventors: Kyosoon Chae, Seoul (KR); Hyundong Kim, Seoul (KR); Sooyoung Oh, Seoul (KR); Jaeyong Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 140 days.

(21) Appl. No.: 16/845,958

(22) Filed: Apr. 10, 2020

(65) Prior Publication Data

US 2020/0325610 A1 Oct. 15, 2020

(30) Foreign Application Priority Data

Apr. 12, 2019 (KR) ..... 10-2019-0042782

(51) Int. Cl.

| | |
|---|---|
| ***D06F 33/37*** | (2020.01) |
| ***D06F 33/47*** | (2020.01) |
| ***D06F 34/14*** | (2020.01) |
| ***D06F 39/02*** | (2006.01) |
| *D06F 105/42* | (2020.01) |

(Continued)

(52) U.S. Cl.

CPC ..... *D06F 33/37* (2020.02); *D06F 33/47* (2020.02); *D06F 34/14* (2020.02); *D06F 39/022* (2013.01); *D06F 39/028* (2013.01); *D06F 2103/22* (2020.02); *D06F 2105/02* (2020.02); *D06F 2105/42* (2020.02)

(58) Field of Classification Search

CPC ..... D06F 33/37; D06F 33/47; D06F 34/14; D06F 2103/22; D06F 2105/02; D06F 2105/42; D06F 2105/58

See application file for complete search history.

(56) References Cited

U.S. PATENT DOCUMENTS 3,561,917 A * 2/1971 Michaels et al. ..... D06F 43/005 8/142
2006/0254626 A1* 11/2006 Botts ..... A47L 15/0055 68/17 R (Continued)

FOREIGN PATENT DOCUMENTS

| | | |
|---|---|---|
| CN | 104088123 | 10/2014 |
| EP | 2521811 B1 | 3/2015 |
| JP | 2018011618 | 1/2018 |

(Continued)

OTHER PUBLICATIONS

Extended European Search Report in European Application No. 20169321.5, dated Sep. 22, 2020, 10 pages.

*Primary Examiner* — Joseph L. Perrin

(74) *Attorney, Agent, or Firm* — Fish & Richardson P.C.

(57) ABSTRACT

A washing machine of the present disclosure includes: a tub in which water is stored; a drum which is rotatably provided in the tub, and accommodates laundry; and a detergent supply device which supplies a liquid additive to the tub, wherein the detergent supply device includes: a cartridge which contains the additive; a pump which extracts the additive contained in the cartridge; an outlet flow path pipe which is connected to the cartridge, and through which the extracted additive flows toward the tub; and a flow path pipe sensor which is installed in the outlet flow path pipe, and detects an existence of the additive in the outlet flow path pipe.

16 Claims, 20 Drawing Sheets

(51) Int. Cl.
*D06F 103/22* (2020.01)
*D06F 105/02* (2020.01)

(56) References Cited

U.S. PATENT DOCUMENTS

| | | | |
|---|---|---|---|
| 2010/0161143 | A1 | 6/2010 | Smith et al. |
| 2015/0067969 | A1 | 3/2015 | Boylston |

FOREIGN PATENT DOCUMENTS

| | | |
|---|---|---|
| KR | 1019990074113 | 10/1999 |
| KR | 1020110099288 | 9/2011 |
| KR | 1020130062271 | 6/2013 |
| WO | WO2006073885 | 7/2006 |

* cited by examiner

WASHING MACHINE AND CONTROL METHOD OF SAME

CROSS-REFERENCE TO RELATED APPLICATION

This application claims the benefit of priority to Korean Application No. 10-2019-0042782, filed on Apr. 12, 2019, the disclosure of which is incorporated by reference in its entirety.

BACKGROUND OF THE INVENTION

1. Field of the Invention

The present disclosure relates to a washing machine and a control method of the same, and more particularly, to a washing machine capable of automatically supplying detergents, and a control method of washing machine.

2. Description of the Related Art

A washing machine is an apparatus for processing laundry through various actions such as washing, dehydration and/or drying. A washing machine is an apparatus that removes contamination from laundry (hereinafter, also referred to as "clothes" or "clothing") by using water and detergent.

Recently, there has been an increasing demand for an automatic detergent supply device that automatically mixes and supplies various types of detergents to suit the clothing, and related technologies are actively being developed.

Patent Publication No. 10-1999-0074113 (hereinafter also referred to as "prior art document 1") relates to a washing machine that detects the amount of detergent in a detergent container and warns for replenishment at a certain level or lower, and discloses a detergent sensor installed in a detergent container or a metering container to detect the amount of detergent.

In the prior art document 1, since a detergent supply passage from the detergent container toward the tub is disposed vertically, the problem that detergent remains in the detergent supply passage may be less than when disposed in a horizontal direction. Thus, the awareness of the problem that detergent remains in the detergent supply passage is not disclosed at all.

However, unlike the water, the detergent has a high viscosity, and even when the detergent supply passage is vertically disposed, the remaining of detergent in the detergent supply passage occurs. Detergent remaining in the detergent supply passage is solidified over time. Accordingly, there is a problem of blocking the detergent supply passage.

The prior art document 1 discloses only a detergent sensor that detects the amount of detergent in the detergent container, but does not disclose a sensor that detects the blocking of the detergent supply passage. Accordingly, in the washing machine of the prior art document 1, when the washing machine is operated in a situation in which the detergent supply passage is blocked, there is a problem in that washing is performed without loading detergent.

Patent Publication No. 10-2011-0099288 (hereinafter, also referred to as "prior art document 2") discloses a modular fluid distribution system including at least one container accommodating fluid, and a fluid level detection system configured to detect a level of fluid in the container.

The prior art document 2 discloses only a detection system that detects the amount of the container in which the fluid is accommodated, and does not disclose a system for detecting whether a tubing through which the fluid taken out from the container flows is blocked. Therefore, there is a problem in that the tubing is blocked as in the prior art document 1, and that washing is performed without loading detergent when the washing machine is operated in a situation where the tubing is blocked.

SUMMARY OF THE INVENTION

The present disclosure has been made in view of the above problems, and provides a washing machine that detects whether the additive remains in a flow path pipe supplying a liquid additive such as detergent to a tub.

The present disclosure further provides a washing machine that prevents a washing course from proceeding without adding additive to the tub.

The present disclosure further provides a washing machine that prevents a flow path pipe from being blocked due to the solidification of the additive.

The present disclosure further provides a washing machine capable of detecting whether a pump for extracting the additive is operated.

In accordance with an aspect of the present disclosure, a washing machine includes: a tub in which water is stored; a drum which is rotatably provided in the tub, and accommodates laundry; and a detergent supply device which supplies a liquid additive to the tub.

The detergent supply device includes: a cartridge which contains the additive; a pump which extracts the additive contained in the cartridge; an outlet flow path pipe which is connected to the cartridge, and through which the extracted additive flows toward the tub; and a flow path pipe sensor which is installed in the outlet flow path pipe, and detects an existence of the additive in the outlet flow path pipe.

The flow path pipe sensor includes a rod electrode disposed in a flow path inside the outlet flow path pipe.

The rod electrode is extended in a direction parallel to the flow path inside the outlet flow path pipe.

The rod electrode is provided in a pair disposed parallel to each other.

The flow path pipe sensor includes a pair of electrode terminals which are bent from the pair of rod electrodes and protrude to the outside of the outlet flow path, respectively.

The washing machine of claim 2, wherein the rod electrode is disposed in a lower portion of the flow path inside the outlet flow path pipe.

The detergent supply device includes a water supply valve which receives water from an external water source and supplies the water to the outlet flow path pipe.

The outlet flow path pipe includes a water supply port which is connected to the water supply valve and into which the water supplied from the water supply valve flows.

A plurality of cartridges are provided, and the additive is contained in each of the plurality of cartridges.

The outlet flow path pipe includes: a plurality of inflow ports into which the additive extracted from the plurality of cartridges is introduced; a joint pipe through which the additive introduced through the plurality of inflow ports flows; and a discharge port which communicates with the joint pipe, and discharges the flowing additive toward the tub.

The joint pipe forms a straight flow path therein.

The flow path pipe sensor includes a pair of rod electrodes which is disposed in the flow path inside the joint pipe, and extended in a direction parallel to the flow path inside the joint pipe.

The detergent supply device includes a plurality of check valve assemblies which are connected to the plurality of cartridges to control the extracting of the additive, and form a space in which the extracted additive is temporarily stored.

The pump extracts the additive by changing a pressure of the space formed in the plurality of check valve assemblies.

The outlet flow path pipe includes: a plurality of inflow ports respectively connected to the plurality of check valve assemblies and into which the extracted additive is introduced; a joint pipe through which the additive introduced through the plurality of inflow ports flows; and a discharge port which communicates with the joint pipe, and discharges the flowing additive toward the tub.

The outlet flow path pipe includes: a first outlet flow path pipe comprising a portion of the plurality of inflow ports, the discharge port, and a first joint pipe guiding additive introduced from the portion of the plurality of inflow ports to the discharge port; a second outlet flow path pipe comprising a remaining portion of the plurality of inflow ports and a second joint pipe through which the additive introduced from the remaining portion of the plurality of inflow ports flows; and a connection hose which connects the first outlet flow path pipe and the second outlet flow path pipe.

The flow path pipe sensor includes a first flow path pipe sensor installed in the first joint pipe, and a second flow path pipe sensor installed in the second joint pipe.

The first outlet flow path pipe and the second outlet flow path pipe are disposed to be spaced apart from each other in a direction in which the plurality of cartridges are disposed.

The detergent supply device includes: an inlet flow path which has a plurality of flow paths respectively communicating with the space formed in the plurality of check valve assemblies; and a flow path switching valve which selectively communicates the pump with any one of a plurality of flow paths of the inlet flow path.

The flow path switching valve is disposed in a spaced portion between the first outlet flow path pipe and the second outlet flow path pipe.

The first flow path pipe sensor includes: a pair of first rod electrodes which are disposed in an inner flow path of the first joint pipe; and a pair of first electrode terminals which are bent from the pair of first rod electrodes and protrude to the outside of the first joint pipe.

The second flow path pipe sensor includes: a pair of second rod electrodes disposed in an inner flow path of the second joint pipe; and a pair of second electrode terminals which are bent from the pair of second rod electrodes and protrude to the outside of the second joint pipe.

The first electrode terminal is bent from a distal end of the second outlet flow path pipe side of the first rod electrode, and the second electrode terminal is bent from a distal end of the first outlet flow path pipe side of the second rod electrode In accordance with another aspect of the present disclosure, a method of controlling a washing machine includes a detergent supply device for supplying a liquid additive from a cartridge to a tub, the method comprising: receiving a first signal for an existence of additive in an outlet flow path pipe through a flow path pipe sensor installed in the outlet flow path pipe through which the additive extracted from the cartridge flows; determining, by a controller, whether the received first signal is the same as additive no-detection data pre-stored in a memory; and extracting the additive from the cartridge into the outlet flow path pipe by operating a pump, when the first signal is the same as the data.

The method further includes outputting a blocking signal of the outlet flow path pipe through an output unit, when the first signal is different from the additive no-detection data.

After extracting the additive, the method further includes supplying water to the outlet flow path through the water supply valve.

After supplying water, the method further includes receiving a second signal for the existence of additive in the outlet flow path pipe through the flow path pipe sensor; and controlling, by the controller, whether the second signal is different from the additive no-detection data.

A plurality of cartridges are provided, and the additive is contained in each of the plurality of cartridges.

The method further includes receiving a washing course through an input unit; detecting an amount of laundry accommodated in the washing machine, after receiving the washing course.

Extracting the additive is performed after detecting an amount of laundry, and includes extracting a preset amount of additive according to the received washing course and the detected amount of laundry.

The method further includes outputting a failure signal of the pump through an output unit, when the second signal is the same as the additive no-detection data.

The method further includes performing the received washing course, when the second signal is different from the additive no-detection data.

BRIEF DESCRIPTION OF THE DRAWINGS

The above and other objects, features and advantages of the present disclosure will be more apparent from the following detailed description in conjunction with the accompanying drawings, in which.

DETAILED DESCRIPTION OF THE PREFERRED EMBODIMENTS

Figure 1:
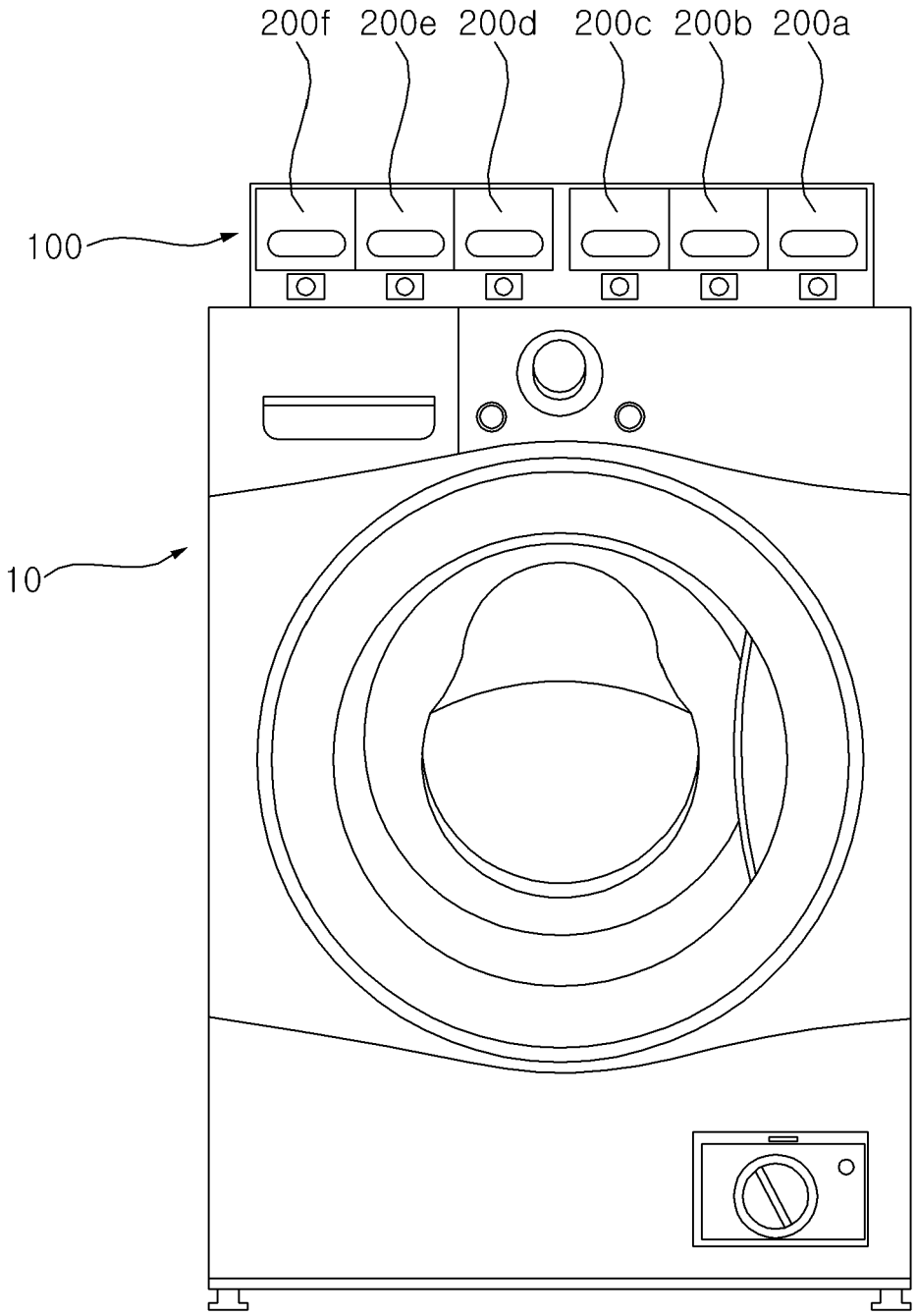
FIG. 1 is a front view of a washing machine according to an embodiment of the present disclosure.

Advantages and features of the present disclosure and methods for achieving them will be made clear from the embodiments described below in detail with reference to the accompanying drawings. The present disclosure may, however, be embodied in many different forms and should not be construed as being limited to the embodiments set forth herein. Rather, these embodiments are provided so that this disclosure will be thorough and complete, and will fully convey the scope of the invention to those skilled in the art. The present disclosure is defined only by the scope of the claims. Like reference numerals refer to like elements throughout the specification.

Hereinafter, the present disclosure will be described with reference to the drawings for explaining a washing machine and a control method of the washing machine according to embodiments of the present disclosure.

Figure 2:
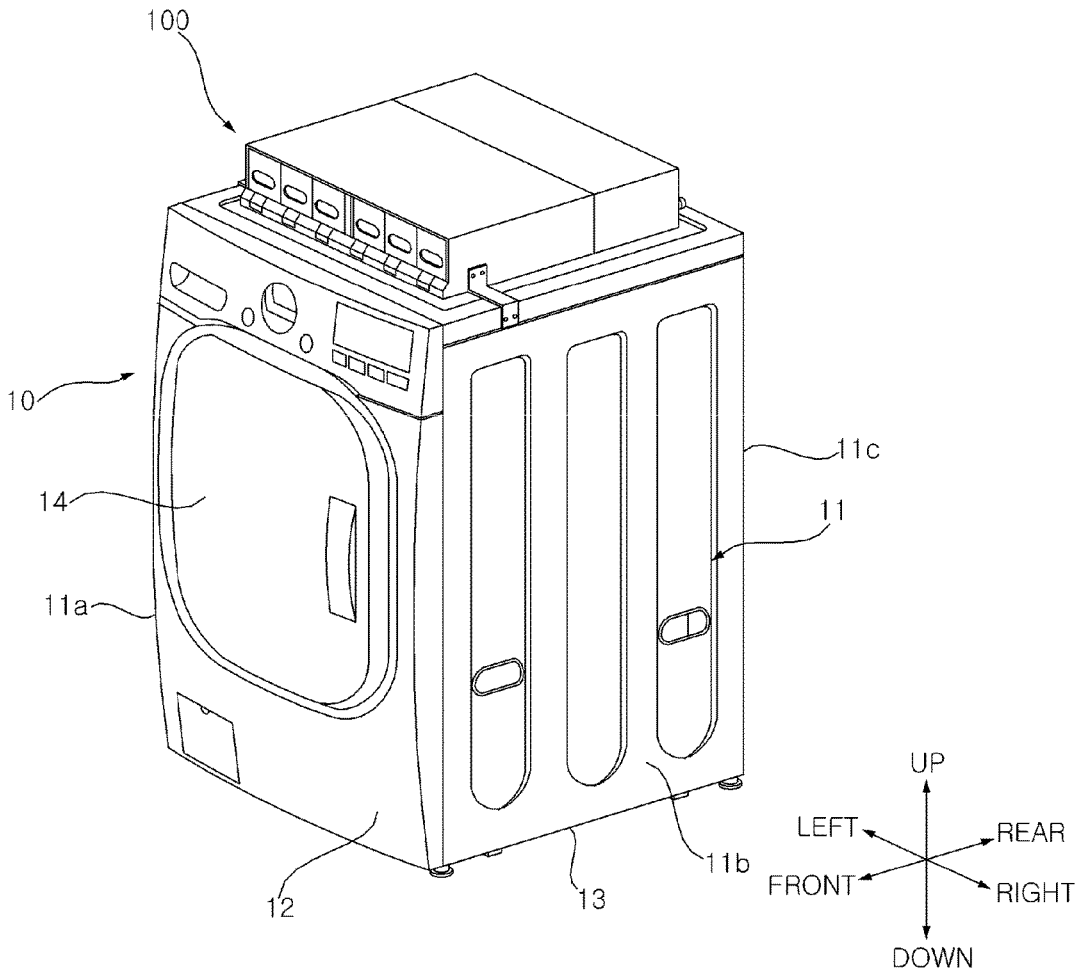
FIG. 2 is a perspective view of a washing machine according to an embodiment of the present disclosure.
Figure 3:
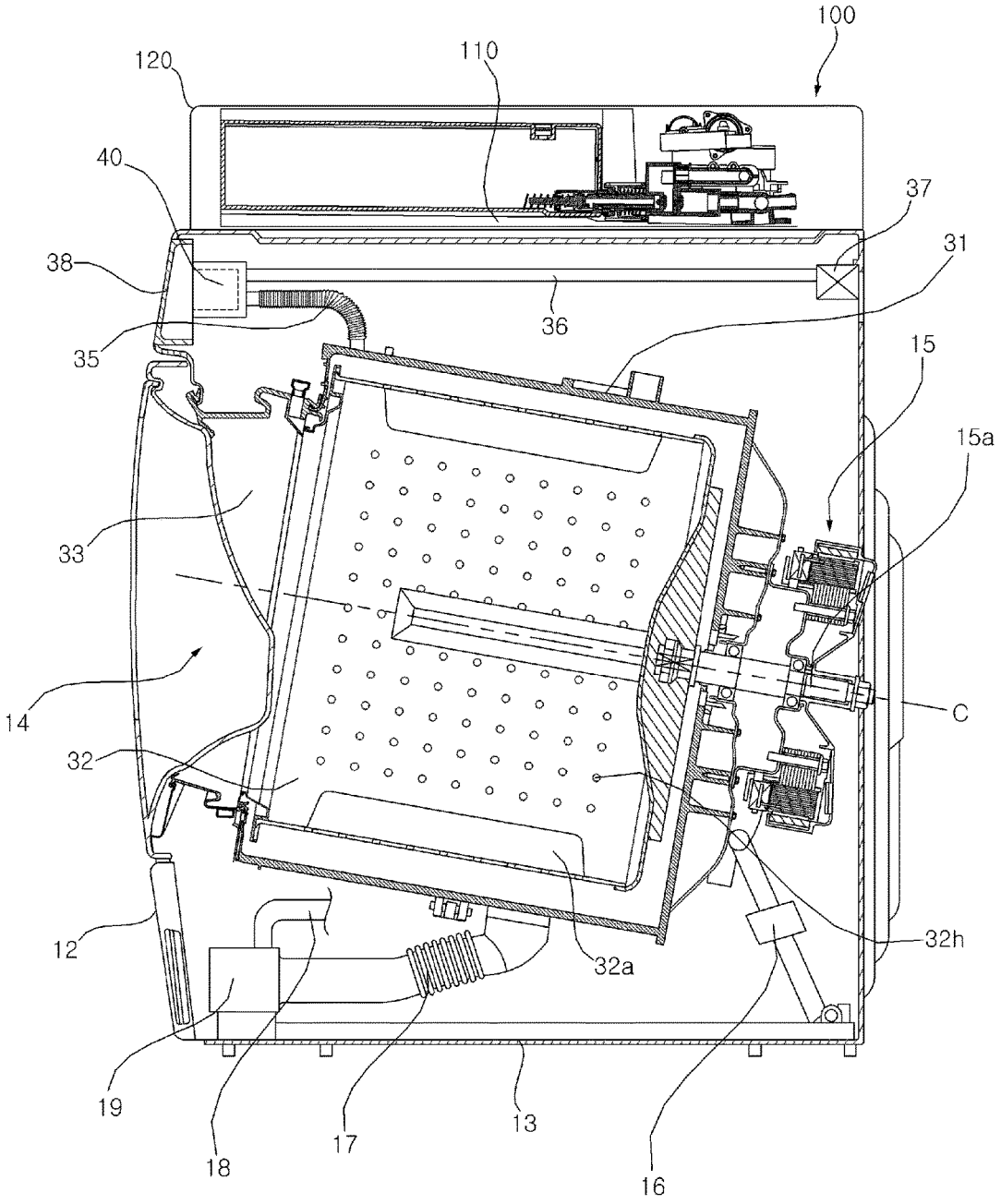
FIG. 3 is a side cross-sectional view of a washing machine according to an embodiment of the present disclosure.

Referring to FIGS. 1 to 3, a washing machine according to an embodiment of the present disclosure includes a tub 31 in which water is stored, a drum 32 which is rotatably provided in the tub 31 and receives laundry, and a detergent supply device for supplying a detergent, a fabric softener, a bleaching agent, and the like (hereinafter, also referred to as "additive") to the tub 31. In addition, the washing machine includes a cabinet 10 in which the tub 31 and the drum 32 are accommodated, and a detergent supply device 100 may be installed in the upper surface of the cabinet 10 separately from a washing machine body, or may be integrally installed with the washing machine body in the inside of the cabinet 10. Hereinafter, a case where the detergent supply device 100 is installed separately from the washing machine body will be described as an example.

The cabinet 10 forms an outer shape of the washing machine, and the tub 31 and the drum 32 are accommodated therein. The cabinet 10 includes a main frame 11 having a front surface that is open and having a left side surface 11*a*, a right side surface 11*b*, and a rear side surface 11*c*, a front panel 12 which is coupled to the open front surface of the main frame 11 and in which a loading port is formed, and a horizontal base 13 supporting the main frame 11 and the front panel 12 from the lower side. The door 14 for opening and closing the loading port is rotatably coupled to the front panel 12.

The front panel 12 and the tub 31 are communicated by an annular gasket 33. The front end portion of the gasket 33 is fixed to the front panel 12, and the rear end portion is fixed around an inlet of the tub 31. The gasket 33 is formed of a material having elasticity, and prevents water in the tub 31 from leaking.

A driving unit 15 is located on the rear side of the drum 32 to rotate the drum 32. In addition, a water supply hose (not shown) for guiding water supplied from an external water source, and a water supply unit 37 for controlling water supplied through the water supply hose to be supplied to a water supply pipe 36 may be provided. The water supply unit 37 may include a water supply valve (not shown) that controls the water supply pipe 36.

The cabinet 10 is provided with a drawer 38 for receiving detergent and a drawer housing 40 in which the drawer 38 is retractably accommodated. The detergent may include bleach or fabric softener as well as laundry detergent. The detergent accommodated in the drawer 38 is supplied to the tub 31 through a water supply bellows 35 when water is supplied through the water supply pipe 36. A water supply port (not shown) connected to the water supply bellows 35 may be formed in the side surface of the tub 31.

A drain hole for discharging water is formed in the tub 31, and a drain bellows 17 is connected to the drain hole. A drain pump 19 is provided to pump and discharge the water discharged from the tub 31 through the drain bellows 17 to the outside of the washing machine.

Referring to FIGS. 5 to 8, the detergent supply device 100 includes a cartridge 200 which contains the additive, a pump 500 for extracting the additive contained in the cartridge 200, an outlet flow path pipe 800 which is connected to the cartridge 200 and through which the extracted additive flows toward the tub 31, and a flow path pipe sensor 900, which detects the additive, that is provided in the outlet flow path pipe 800. In addition, the detergent supply device 100 may include a cartridge sensor 300 for detecting the amount of the additive contained in the cartridge 200, and a water supply valve 830 which receives water from an external water source and supplies the water to the outlet flow path pipe 800.

A plurality of cartridges 200 may be provided, and the additive may be contained in each of the plurality of cartridges 200*a*, 200*b*, 200*c*, 200*d*, 200*e*, 200*f* (hereinafter, 200).

In addition, the detergent supply device 100 may include a plurality of check valve assemblies 400*a*, 400*b*, 400*c*, 400*d*, 400*e*, 400*f* (hereinafter, 400) which are connected to a plurality of cartridges 200 respectively and control the extracting of the additive, an inlet flow path 700 which is provided with a plurality of flow paths 700*a*, 700*b*, 700*c*, 700*d*, 700*e*, 700*f* connected to the plurality of check valve assemblies 400 respectively and transmits the pressure change generated by the pump 500 to the check valve assembly 400, and a flow path switching valve 600 which is connected to the pump 500 and the inlet flow path 700 and selectively communicate the pump 500 with any one flow path (e.g. 700*a*) of the plurality of flow paths 700*a*, 700*b*, 700*c*, 700*d*, 700*e*, 700*f* (hereinafter, 700*a*) of the inlet flow path 700.

In the check valve assembly 400, a space S2 in which the extracted additive is temporarily stored is formed, and the pump 500 can extract the additive from the plurality of cartridges by changing the pressure in the space. The outlet flow path pipe 800 is provided with a plurality of inflow ports 850*a*, 850*b*, 850*c*, 850*d*, 850*e*, 850*f* (hereinafter, 850) which are connected to the plurality of check valve assemblies respectively, so that the extracted additive can be discharged to the outlet flow path pipe 800.

The detergent supply device 100 includes a housing 110 that has an inlet formed in the front surface and defines an accommodation space therein, and a cover 120 that opens and closes the housing 110.

A plurality of openings formed of a rectangular parallelepiped are formed in the front side of the housing 110, and each opening is extended to the rear side of the housing 110 to form a cartridge accommodating space for each opening. Accordingly, a plurality of cartridges 200 may be inserted into the respective opening spaces through the front opening.

Each cartridge 200 contains additive, for example, general laundry detergents, wool detergents, baby clothes detergents, outdoor clothes detergents, bleaching agents, fabric softeners, and the like. The additive may be a liquid additive.

The cartridge 200 according to the embodiment of the present disclosure is formed of six units, but the number does not need to be limited thereto, and preferably, three or more units may be provided.

In the rear space of the cartridge 200 accommodating space, an accommodating space in which detergent supply parts such as a flow path 700, 800, a flow path switching valve 600, and a pump 500 are installed is formed. A rear wall 111*a*, 111*b*, 111*c*, 111*d*, 111*e*, 111*f*, (hereinafter, 111) is installed between the cartridge accommodating space and a rear part accommodating space, and an electrode sensor 300 (hereinafter, also referred to as "a cartridge sensor") including an electrode plate and a terminal described later is installed in the rear wall.

Figure 4:
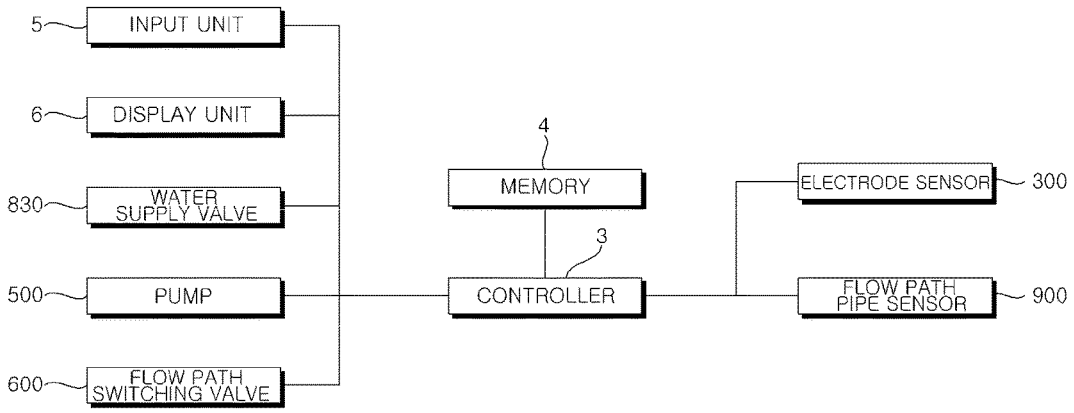
FIG. 4 is a block diagram showing a control of a washing machine according to an embodiment of the present disclosure.

Referring to FIG. 4, the detergent supply device 100 may include a controller 3 for controlling the pump 500, the flow path switching valve 600, and the like. The controller 3 may be installed in a main body of the washing machine, or may be separately installed inside the detergent supply device 100 to exchange information with a controller installed in the main body of the washing machine.

The pump 500 and the flow path switching valve 600 may be controlled by the controller 3. The memory 4 stores information related to a signal (hereinafter, also referred to as "no additive detection data") received from the flow path pipe sensor when additive is not exist in the outlet flow path pipe 800. In addition, information related to additive, such as components constituting the additives and composition ratio of the components, may be stored in the memory 4. Each cartridge 200 accommodates any one of the above components, and the controller 3 may control the pump 500 and the flow path switching valve 600 based on additive information stored in the memory 4.

The washing machine may further include an input unit 5 that receives various control commands for the operation of the washing machine from a user. The input unit 5 may be provided in an upper portion of the front panel 12. The front panel 12 may be further provided with a display unit 6 (hereinafter, also referred to as 'output unit') for displaying the operating state of the washing machine.

According to the setting input by the user through the input unit 5, the controller 3 may select an additive type from the memory 4 and check corresponding additive information. Then, the controller 3 may control the operation of the pump 500 and the flow path switching valve 600 to form the additive selected in this way. That is, it is possible to control the operation of the pump 500 and the flow path switching valve 600 corresponding to the cartridge 200 accommodating the additive according to the additive that make up the selected additive and the composition ratio of the additive.

Hereinafter, the cartridge 200 and the cartridge sensor 300 will be described with reference to FIGS. 3 and 5 to 11.

The detergent supply device 100 includes a cartridge 200 containing additives. A plurality of cartridges 200 may be provided, and additives may be contained in each of the plurality of cartridges 200.

The cartridge 200 includes a cartridge body 210*a*, 210*b*, 210*c*, 210*d*, 210*e*, 210*f* (hereinafter, 210) forming a main body and storing the additive, a first opening 211*a*, 211*b*, 211*c*, 211*d*, 211*e*, 211*f* (hereinafter, 211) into which the additive can be added to the cartridge body 210, a cap 220*a*, 220*b*, 220*c*, 220*d*, 220*e*, 220*f* (hereinafter, 220) that can open and close the first opening, a membrane 230 which passes air inside and outside the cartridge 200, a second opening 213*a*, 213*b*, 213*c*, 213*d*, 213*e*, 213*f* (hereinafter, 213) in which the membrane 230 is installed, a cartridge locker 240*a*, 240*b*, 240*c*, 240*d*, 240*e*, 240*f* (hereinafter, 240) to allow the cartridge 200 to be fixed to the housing 110 when the cartridge 200 is inserted into the housing 110, a docking valve 250*a*, 250*b*, 250*c*, 250*d*, 250*e*, 250*f* (hereinafter, 250) connecting the check valve assembly 400 and the cartridge 200, and a rib 260*a*, 260*b*, 260*c*, 260*d*, 260*e*, 260*f* (hereinafter, 260) that prevent additive from contacting the membrane 230.

The cartridge body 210 is formed to correspond to the shape of the housing 110 so as to be inserted and coupled to the cartridge accommodating space formed in the front side of the housing 110. According to an embodiment of the present disclosure, a cartridge accommodating portion 110*a*, 110*b*, 110*c*, 110*d*, 110*e*, 110*f* (hereinafter 110) of the housing 110 is formed in the shape of a rectangular parallelepiped, the cartridge 200 is also formed in a corresponding rectangular parallelepiped, but the edge is formed to be rounded to minimize wear when the cartridge 200 is detached.

The cartridge body 210 has a docking valve insertion hole formed in one surface thereof, and the docking valve 250 may be inserted into the insertion hole and installed in the cartridge body 210. The docking valve insertion hole may be formed in the rear surface of the cartridge body 210. The insertion hole may be formed below the rear surface so that additive can flow out to the check valve assembly 400 through the docking valve 250 even when a small amount of additive is contained in the cartridge.

For the above reasons, the cartridge 200 may be installed to be inclined downward toward the rear. In more detail, the cartridge 200 may be disposed such that the bottom surface inside the cartridge body 210 is inclined downward toward the direction in which the insertion hole is formed. When the insertion hole is formed in the rear surface of the cartridge body 210, the cartridge 200 may be disposed such that the bottom surface inside the cartridge body 210 is inclined downward toward the rear side.

Meanwhile, the cartridge sensor 300 is an electrode sensor, and outputs a signal when two electrodes spaced apart from each other, which are positive (+) and negative (−) poles, are conducted through a medium. The cartridge sensor 300 is installed in the rear wall 111 formed as the housing 110 in the rear side of the inserted cartridge 200. More specifically, an electrode plate 321, 322, 323, 324, 325, 326 (hereinafter, 321) is installed between the rear wall and the cartridge body 210. A terminal 311, 312, 313, 314, 315, 316 (hereinafter, 311) is installed in a rear wall protrusion 111*a*1, 111*b*1, 111*c*1, 111*d*1, 111*e*1, 111*f*1 (hereinafter, 111*a*1) protruding from the rear wall to the rear side of the detergent supply device. The terminal is provided with a protrusion portion 311-1, 312-1, 313-1, 314-1, 315-1, 316-1 (hereinafter, 311-1) having a forward curvature, and the protrusion portion is in contact with the electrode plate while pushing the electrode plate toward the cartridge, thereby receiving an electrical signal from the electrode plate.

The electrode plate 321 is connected with the terminal 311 by a rear wall electrode plate opening 112-1, 112-2, 112-3, 112-4, 112-5, 112-6 (hereinafter, 112-1), and is in contact with the inside of the cartridge by a cartridge electrode plate opening (216-1, 216-2, 216-3, 216-4, 216-5, 216-6 (hereinafter, 216-1), so that it may be in contact with the additive contained in the cartridge, in the front side, to flow the current and may transmit an electrical signal to the controller 3 through the terminal in the rear side.

According to an embodiment of the present disclosure, three terminals and three electrode plates are provided for each cartridge. A first terminal 311*a*, 312*a*, 313*a*, 314*a*, 315*a*, 316*a* (hereinafter, 311*a*) and a first electrode plate 321*a*, 322*a*, 323*a*, 324*a*, 325*a*, 326*a* (hereinafter, 321*a*), and a second terminal 311*b*, 312*b*, 313*b*, 314*b*, 315*b*, 316*b* (hereinafter, 311*b*) and a second electrode plate 321*b*, 322*b*, 323*b*, 324*b*, 325*b*, 326*b* (hereinafter, 321*b*) are provided in one side based on the lower side of the cartridge and the docking valve 250*a*, 250*b*, 250*c*, 250*d*, 250*e*, 250*f* (hereinafter, 250).

A third terminal 311*c*, 312*c*, 313*c*, 314*c*, 315*c*, 316*c* (hereinafter, 311*c*) and a third electrode plate 321*c*, 322*c*, 323*c*, 324*c*, 325*c*, 326*c* (hereinafter, 321*c*) are provided in the other side based on the upper side of the cartridge and the docking valve 250.

The cartridge sensor 300 outputs a signal when two electrodes spaced apart from each other, which are positive (+) and negative (−) poles, are conducted through the medium. Therefore, when the additive is sufficiently contained in the cartridge, the additive serves as a medium to allow current to pass through, and the terminal detects this to detect the amount of the additive inside the cartridge.

When only two electrode plates 321 and terminals 311 of the cartridge sensor 300 are installed for each cartridge, the amount of the additive may be incorrectly detected due to the reason that the cartridge is shaken or the additive is solidified around the electrode sensor.

According to an embodiment of the present disclosure, the first and second electrode plates 321*a* and 321*b* are formed of different electrodes, respectively, and are installed below the cartridge 200, and the third electrode plate 321*c* is installed above the cartridge 200*a*. Thus, a first cartridge signal may be generated when first and second electrode plates are electrically conducted to each other, and a second cartridge signal may be generated when the first or second electrode plate and the third electrode plate are electrically conducted. Accordingly, it is possible to detect the additive amount of the cartridge by synthesizing the first and second cartridge signals and, furthermore, to determine whether the electrode sensor is failed or not installed.

More specifically, if both the first and second cartridge signals are not detected, it can be determined that the cartridge is almost empty or not installed, and if only the second cartridge signal is detected, it can be determined that the cartridge sensor 300 is failed or has a contact failure. When only the first cartridge signal is detected, it can be determined that the amount of the additive is insufficient, and when both the first and second cartridge signals are detected, it can be determined that the cartridge 200 contains sufficient additive.

The determination result through the first and second cartridge signals may be displayed through a display unit 6 so that the user can easily recognize the determination result. Meanwhile, in the embodiment of the present disclosure, the first and second electrode plates are provided in a lower side, and the third electrode plate is installed in an upper side, but the present disclosure is not limited thereto, and it is enough that at least three electrode plates having different heights are provided to minimize the case where the amount of additive is detected incorrectly.

According to an embodiment of the present disclosure, the shapes of the first and second electrode plates 321*a* and 321*b* have a shape of the giyeok (or "L" shape), which is the first letter of the Korean alphabet, rather than a general square shape. This can minimize the interference between the first and second electrode plates by making the width of the lower portion of the electrode plate with which the additive is in contact, because the signal due to conduction may be incorrectly detected by the interference between the electrodes if the two electrodes are so close together. However, the shape of the electrode plate is not limited to the shape of the giyeok (or "L" shape) according to the embodiment of the present disclosure, and any shape that can minimize interference between the two electrodes is sufficient.

Hereinafter, the structure of the check valve assembly 400 will be described with reference to FIGS. 5 to 8 and 11.

The plurality of check valve assemblies 400 are respectively connected to the plurality of cartridges 200 to control the extracting of the additive. In the check valve assembly 400, a space S2 in which the extracted additive is temporarily stored is formed. In the space S2 formed in the check valve assembly 400, the pressure from the pump 500 is changed, and thus, the additive contained in the cartridge is extracted to the space S2.

The check valve assembly 400 may include a first check valve housing 410*a*, 410*b*, 410*c*, 410*d*, 410*e*, 410*f* (hereinafter, 410) which forms a space S2 in which the additive extracted from the cartridge 200 is temporarily stored, a first check valve installed in the first check valve housing 420*a*, 420*b*, 420*c*, 420*d*, 420*e*, 420*f* (hereinafter, 420), a second check valve housing 460*a*, 460*b*, 460*c*, 460*d*, 460*e*, 460*f* (hereinafter, 460) which is in communication with the first check valve housing 410 and is connected to each of a plurality of inflow ports 850 provided in an outlet flow path pipe 800, and a second check valve 470 installed in the second check valve housing 460.

In addition, the check valve assembly 400 may include a check valve cap 430*a*, 430*b*, 430*c*, 430*d*, 430*e*, 430*f* (hereinafter, 430) which prevents additive and air from leaking through the first check valve 420, and a docking pipe 440*a*, 440*b*, 440*c*, 440*d*, 440*e*, 440*f* (hereinafter, 440) which is coupled to the docking valve 250 of the cartridge 200 and can move the additive of the cartridge 200 in the direction of the check valve.

A first discharge hole 421 communicating with the cartridge 200 may be formed in the first check valve housing 410. The space S2 inside the first check valve housing 410 communicates with the cartridge 200 by a space S1 formed in a docking pipe described later and the first discharge hole 421.

The first check valve 420 opens and closes the first discharge hole 421 to control the extracting of the additive from the cartridge 200 to the space S2 of the first check valve housing. When the first check valve 420 is separated from the peripheral portion of the first discharge hole 421 of the first check valve housing 410 to open the first discharge hole 421, the additive contained in the cartridge 200 is extracted to the space S2 of the first check valve housing. When the first check valve 420 is in contact with the peripheral portion of the first discharge hole 421 of the first check valve housing 410 to close the first discharge hole 421, the additive contained in the cartridge 200 is not extracted to the space S2 of the first check valve housing.

The first check valve housing 410 includes an inlet flow path connection portion 461*a*, 461*b*, 461*c*, 461*d*, 461*e*, 461*f* (hereinafter, 461) connected to an inlet flow path. The inlet flow path connection portion 461 is tightly coupled to an inlet flow path 700 through an inlet flow path connection plug 462*a*, 462*b*, 462*c*, 462*d*, 462*e*, 462*f* (hereinafter, 462). The plurality of check valve assemblies 400 are respectively connected to the plurality of flow paths 700*a*, 700*b*, 700*c*, 700*d*, 700*e*, 700*f* of the inlet flow path 700 described later through the inlet flow path connection portion 461.

Meanwhile, in the first check valve housing 410, the opposite side where the first discharge hole is formed is opened, the second check valve housing 460 having the inlet flow path connection portion 461 is coupled to the opened portion, so that the check valve assembly 400 and the inlet flow path 700 may be connected.

The docking pipe 440 is provided with a detergent inlet 441*a*, 441*b*, 441*c*, 441*d*, 441*e*, 441*f* (hereinafter 441) into which additive supplied from the cartridge 200 flows through the docking valve 250, a flow path (hereinafter, also referred to as a space S1) communicating with the detergent inlet 441 is formed inside the docking pipe 440.

When the cartridge 200 is detached from the cartridge accommodating space of the housing 110, the docking valve 250 is closed, and when it is inserted into the cartridge accommodating space, the docking valve 250 is pushed by the docking pipe 440 and opened, so that the additive contained in the cartridge 200 flows into the inner space S1 of the docking pipe through the detergent inlet 441.

In the docking pipe 440, a first docking pipe O-ring 442*a*, 442*b*, 442*c*, 442*d*, 442*e*, 442*f* (hereinafter, 442) and a second docking pipe O-ring 443*a*, 443*b*, 443*c*, 443*d*, 443*e*, 443*f*, 442*f* (hereinafter, 443) are inserted and install in a first docking pipe O-ring groove 442*a*-1, 442*b*-1, 442*c*-1, 442*d*-1, 442*e*-1, 442*f*-1 (hereinafter, 442-1) and a second docking pipe O-ring groove 443*a*-1, 443*b*-1, 443*c*-1, 443*d*-1, 443*e*-1, 443*f*-1 (hereinafter, 443-1), while the detergent inlet is interposed therebetween. This is to prevent the additive from leaking outside when it enters the detergent inlet.

The check valve assembly 400 may include a docking pipe circumferential portion 450*a*, 450*b*, 450*c*, 450*d*, 450*e*, 450*f* (hereinafter, 450) coupled to the docking valve 250 around the docking pipe. The docking pipe circumferential portion 450 is provided with a docking pipe spring 451*a*, 451*b*, 451*c*, 451*d*, 451*e*, 451*f* (hereinafter, 451). The coupling between the check valve assembly 400 and the docking valve 250 is secured through the elastic force of the docking pipe spring. When the cartridge 200 is separated from the housing 110, it can be more easily separated due to elastic force.

Between the first check valve housing 410 and the second check valve housing 460, a check valve o-ring 411*a*, 411*b*, 411*c*, 411*d*, 411*e*, 411*f* (hereinafter, 411) is inserted and install so that the first check valve housing 410 and the second check valve housing 460 are connected and, at the same time, sealed to prevent air from leaking. Alternatively, the first check valve housing 410 and the second check valve housing 460 may be integrally formed.

The second check valve housing 460 is provided with a second discharge hole 471 communicating with the space S2 of the first check valve housing. The second check valve housing 460 is coupled to an outlet flow path connection pipe 480 to form a space S3 therein.

The outlet flow path connection pipe 480 may be integrally formed with the second check valve housing 460, or separately provided to be coupled to the second check valve housing. The outlet flow path connection pipe 480 is coupled to the inflow port 850 of the outlet flow path pipe 800 to communicate the space S3 of the second check valve housing 460 with the outlet flow path pipe 800.

The outlet flow path connection pipe 480 is coupled to an outlet flow path connection portion 463 formed in a distal end of the second check valve housing 460, and is firmly coupled to the second check valve housing 460 by the outlet flow path connection O-ring 482*a*, 482*b*, 482*c*, 482*d*, 482*e*, 482*f* (hereinafter, 482). The outlet flow path connection pipe is tightly coupled to the inflow port 850 of the outlet flow path pipe 800 by the outlet flow path connection plug 481*a*, 481*b*, 481*c*, 481*d*, 481*e*, 481*f* (hereinafter, 481).

The second check valve 470 opens and closes the second discharge hole 471 to control of the discharge of the additive from the space S2 of the first check valve housing to the space S3 of the second check valve housing. When the second check valve 470 is separated from the peripheral portion of the second discharge hole 471 of the second check valve housing 460 to open the second discharge hole 471, the additive temporarily stored in the space S2 of the first check valve housing can be discharged to the space S3 of the second check valve housing. When the second check valve 470 contacts the peripheral portion of the second discharge hole 471 of the second check valve housing 410 and closes the second discharge hole 471, the additive temporarily stored in the space S2 of the first check valve housing is not discharged into the space S3 of the second check valve housing.

The first check valve 420 may be disposed to open the first discharge hole 421, in the inside S2 of the first check valve housing 410, and the second check valve 470 may be disposed to open and close the second discharge hole 471, in the inside S3 of the second check valve housing 460. The first check valve 420 and the second check valve 470 may be installed to be opened in the same direction.

This is because when two check valves are installed to be opened in different directions, it is impossible to form a negative pressure in the second space S2 so as to extract the additive. Among the first check valve 420 and the second check valve 470 according to the embodiment of the present disclosure, it is possible that the first check valve 420 is opened only to the second space S2, and the second check valve 470 is opened only to the third space S3.

The first and second check valves 420 and 470 have a circular hemispherical shape and use an elastic rubber material. One end of the first and second check valves 420 and 470 is formed of a protrusion portion 423, 473 to be fitted into the first and second discharge holes 422 and 472 formed in the center of the first and second discharge holes 421 and 471. The other end of the first and second check valves 420 and 470 is formed of a hemisphere portion 424 and 474 having a hemispherical shape, so that a flat surface of the hemisphere portion may be seated in the first and second discharge surfaces 425 and 475 where the first and second discharge holes 421 and 471 are formed.

The distal end of the protrusion portion 423 and 473 is formed to be thicker than the middle, and the distal end of the protrusion portion 423 and 473 is caught in the rear surface of the first and second discharge holes 422 and 472 so that the first and second check valves 420, 470 are fixed to the first and second discharge holes 421 and 471.

When the pressure of the fluid through a piston 580 described later is transmitted in the direction of the hemisphere portion 424 and 474 of the first and second check valves 420 and 470, the flat portion of the hemisphere portion 424 and 474 is in close contact with the first and second discharge holes 421 and 471 that are in contact with each other due to the pressure of the fluid, thereby closing the first and second discharge holes. Therefore, the additive cannot enter the inlet flow path 700 or the outlet flow path pipe 800 through the closed first and second discharge holes.

On the other hand, when the pressure of the fluid through the piston 580 is transmitted in the direction of the protrusion portion 423 and 473 of the first and second check valves 420 and 470, the flat portion of the hemisphere portion 424 and 474 is separated from the first and second discharge holes 421 and 471 that are in contact with each other due to the air pressure to open the first and second discharge holes. Therefore, the additive may enter the inlet flow path 700 or the outlet flow path pipe 800 through the opened first and second discharge holes. This is because the first and second check valves 420 and 470 are formed of an elastic material, the shape and position of the protrusion portion 423 and 473 and the hemisphere portion 424 and 474 may be changed by negative pressure or positive pressure.

According to an embodiment of the present disclosure, the first and second check valves 420 and 470 may be formed of rubber. Since the first and second check valves 420 and 470 formed of an elastic material can be manufactured in a compact size in comparison with a check valve using a conventional spring, a structure such as a spring length and a shaft supporting the spring is not required so that the check valve can be miniaturized, and the size of the second space S2 formed through the check valve can be reduced.

However, the first and second check valves 420 and 470 are not limited to the above-described structure, and may be the above-described conventional check valves having an elastic plug, a spring, and a spring shaft.

Meanwhile, when the piston 580 of the pump 500 described later reciprocates within a cylinder, a space S2 of the first check valve housing should be formed with a volume equal to or greater than the reciprocating volume formed inside the cylinder. This is because when the piston reciprocating volume inside the cylinder exceeds the volume of the first check valve housing space S2, the additive may overflow into the inlet flow path 700 or the outlet flow path pipe 800 described later.

In addition, the outlet flow path connection pipe 480 connected to the outlet flow path pipe 800 is formed in a lower position than the first discharge hole 421 which connects the space S1 of the docking pipe and the space S2 of the first check valve assembly to discharge the additive in the space S1 of the docking pipe into the space S2 of the first check valve assembly, and the second discharge hole 471 that connects the space S2 of the first check valve assembly and the space S3 of the second check valve assembly to discharge the additive in the second space S2 into the third space S3. Therefore, the additive that passed through the first and second discharge holes 421 and 471 can be more properly flowed into the outlet flow path pipe 800 due to the potential energy.

Figure 11:
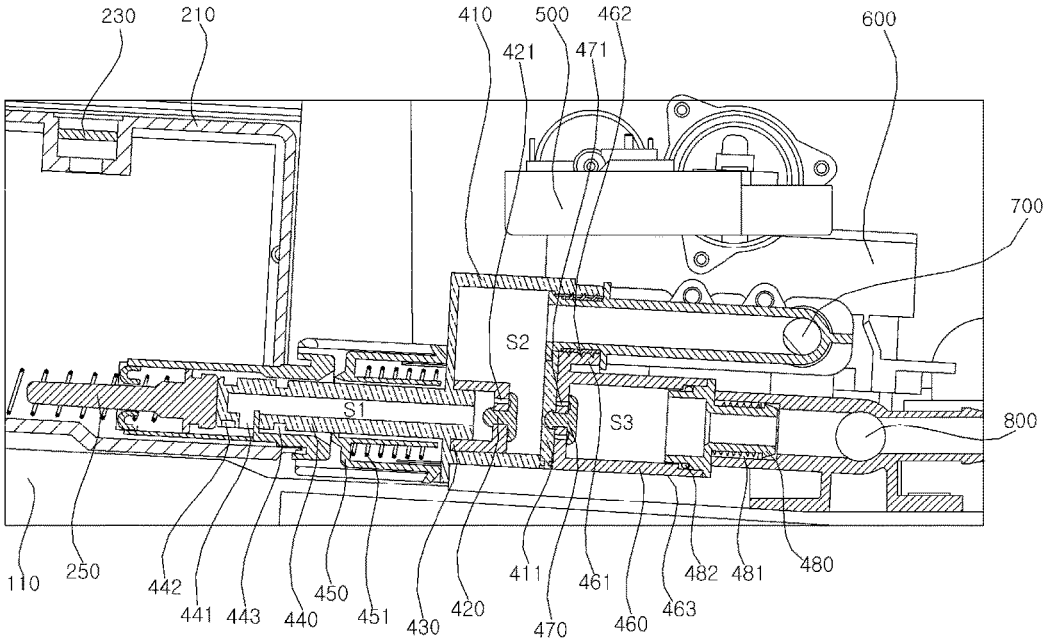
FIG. 11 is a cross-sectional view of a check valve assembly shown in FIG. 8.

Hereinafter, the operation of the check valve assembly 400 will be described with reference to FIGS. 11 and 16.

Figure 16A:
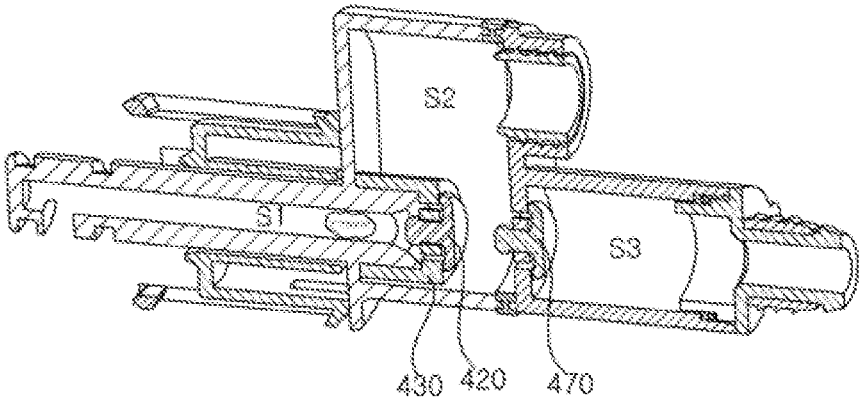
FIGS. 16A to 16C are operation state diagrams showing that the additive is extracted through a check valve.

FIG. 16A shows the state in which a cartridge 200 is inserted into the cartridge accommodating space and is coupled to the check valve assembly 400, and the additive (or detergent) is accommodated in the cartridge 200 and the inner space S1 of the docking pipe before the pump 500 is operated.

Figure 16B:
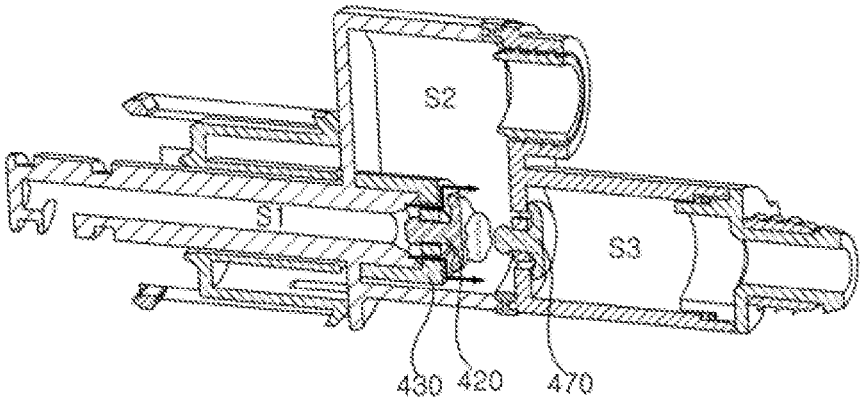

FIG. 16B shows a state in which the pressure in the space S2 of the first check valve housing 410 is decreased due to the retraction of the piston 580. The pressure is decreased in the space S2 of the first check valve housing 410, so that the first check valve 420 is opened and detergent is extracted into the space S2 of the first check valve housing 410, and the second check valve 470 is closed so that detergent is temporarily stored in the space S2 of the first check valve housing 410.

Figure 16C:
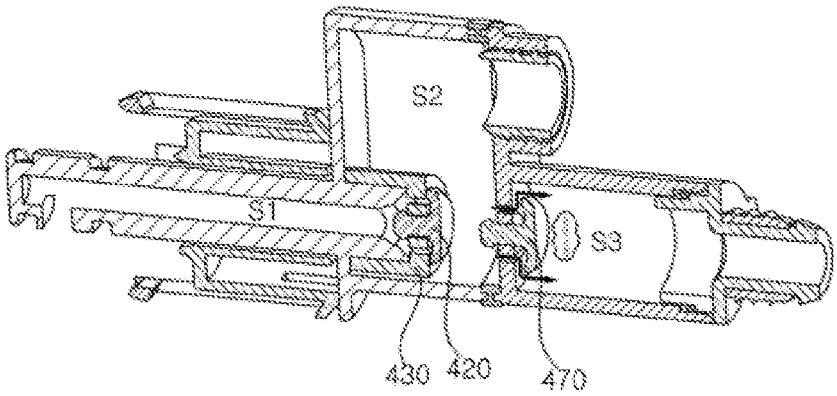
Figure 17:
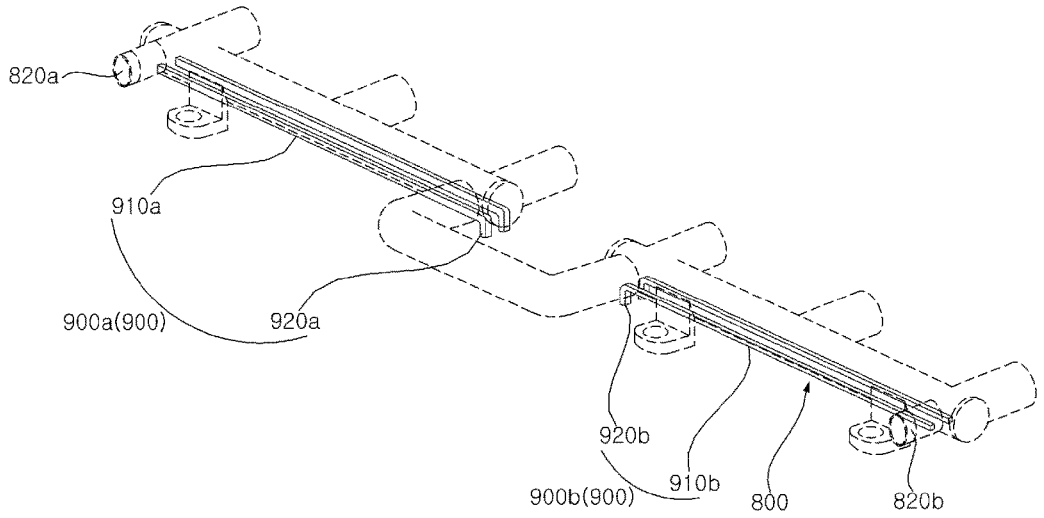
FIG. 17 is a view showing a flow path pipe sensor of the detergent supply device shown in FIG. 6.

FIG. 16C shows a state in which the pressure in the space S2 of the first check valve housing 410 is increased as the piston 580 moves forward. The pressure is increased in the space S2 of the first check valve housing 410, so that the first check valve 420 is opened, and the second check valve 470 is closed. Accordingly, the additive temporarily stored in the first check valve housing 410 is discharged to the space S3 of the second check valve housing 460.

The negative pressure or positive pressure generated by the forward/rearward movement of the piston 580 provided in the pump 500 is transmitted to the space S2 (hereinafter, also referred to as a second space) of the first check valve housing 410 through the inlet flow path 700.

When the piston 580 moves forward toward the inlet flow path 700 in the cylinder, the first check valve 420 closes the first discharge hole, and the second check valve 470 opens the second discharge hole 471. When the piston 580 moves rearward to the opposite side of the inlet flow path 700 in the cylinder, the first check valve 420 opens the first discharge hole 421, and the second check valve 470 closes the second discharge hole 471.

According to an embodiment of the present disclosure, the piston 580 moves rearward, and thus, the generated negative pressure is transmitted to the second space S2 through the inlet flow path 700. Therefore, the first check valve 420 is opened by the negative pressure applied to the second space S2. In addition, the additive inside the cartridge 200 enters the second space S2 via the first check valve 420 through the space S1 (hereinafter, also referred to as a first space) of the docking pipe 440 due to the negative pressure applied to the second space S2.

When the additive enters the second space S2, the piston 580 moves forward, and thus, the generated positive pressure is transmitted to the second space S2 through the inlet flow path 700 again. Therefore, the second check valve 470 is opened by the positive pressure applied to the second space, and the first check valve 420 is positioned while being blocked. Therefore, the additive in the second space S2 is supplied to the space S3 (hereinafter, also referred to as a third space) of the second check valve housing 460, due to positive pressure applied to the second space S2. The additive supplied to the third space S3 may be discharged to the outlet flow path pipe 800 by positive pressure applied to the second space S2 and the third space S3, and may be supplied to the tub 31 or a drawer 39 together with supplied water.

As described above, the check valve according to the embodiment of the present invention is designed to effectively transmit the pressure change due to the piston reciprocating motion when discharging the additive in a container by applying the pressure change due to the piston motion, two first and second check valves 420 and 470 are used to discharge additive during reciprocating motion of the piston, in order to move the liquid according to the pressure change.

Hereinafter, the structure and operation of the pump 500 will be described with reference to FIGS. 5 to 8 and 13.

The detergent supply device 100 may include one or more pumps 500. The pump 500 may be provided in a number less than the number of cartridges 200.

The detergent supply device 100 includes a single pump 500 and a single flow path switching valve 600 to selectively extract the additive contained in the plurality of cartridges 200.

Alternatively, the detergent supply device 100 may include two or more pumps 500 and the flow path switching valve 600 having the same number as the pump 500.

For example, the detergent supply device 100 may include two first and second pumps 500 and two first and second flow path switching valves 600. The first pump may be connected to some cartridges (e.g., 200*a*, 200*b*, 200*c*) which are one or more of the plurality of cartridges 200*a*, 200*b*, 200*c*, 200*d*, 200*e*, 200*f* through the first flow path switching valve, can selectively extract the additive contained therein, and the second pump may be connected to the remaining part of the cartridges (e.g., 200*d*, 200*e*, 200*f*) through the second flow path switching valve, so that the additive contained therein can be selectively extracted.

Alternatively, the detergent supply device 100 may include two or more pumps 500 and fewer flow path switching valves 600 than the pumps 500.

For example, the detergent supply device 100 may include two first and second pumps 500 and a single flow path switching valve 600. The first pump is not connected to a flow path switching valve, but connected to any one cartridge (e.g., 200*a*) of the plurality of cartridges 200*a*, 200*b*, 200*c*, 200*d*, 200*e*, 200*f* so that the additive contained therein can be extracted. The second pump is connected to the remaining cartridges (e.g. 200*b*, 200*c*, 200*d*, 200*e*, 200*f*) through a flow path switching valve, so that the additive contained therein can be selectively extracted.

Meanwhile, a plurality of inlet flow paths 700 described later may also be provided. At least one inlet flow path 700 may include two or more flow paths respectively communicating with two or more check valve assemblies of the plurality of check valve assemblies 400.

The pump 500 may change the pressure of the space S2 formed in the check valve assembly 400 communicating with two or more flow paths of the inlet flow path 700 to extract additive, and the flow path switching valve 600 may selectively communicate the pump 500 with any one of two or more flow paths of the inlet flow path 700. The flow path switching valve 600 may communicate the cylinder 590 of the pump 500 with any one of two or more flow paths of the inlet flow path 700. When the pump is operated, the additive may be extracted to the space S2 formed in the check valve assembly in communication with the cylinder 590 and any one flow path.

Meanwhile, when the detergent supply device 100 includes a plurality of pumps 500, cartridges connected to different pumps may be classified and may guide a user to contain additive.

For example, it is known that general detergents and fabric softeners are easily solidified when mixing. Therefore, each cartridge can be marked so that the general detergent can be contained in any one of the cartridges connected to the first pump, and the fabric softener can be contained in any one of the cartridges connected to the second pump. In addition, since babies have weak skin, it is undesirable to mix bleach when washing baby clothes. Accordingly, each cartridge can be marked so that the baby clothes detergent can be contained in another of the cartridges connected to the first pump, and the bleach can be contained in the other of the cartridges connected to the second pump.

Hereinafter, the case where the detergent supply device 100 is provided with one pump 500 will be described as an example, but the number of the pumps 500 is not limited to one, and it is sufficient if at least one pump 500 is connected to two or more cartridges 200 through the flow path switching valve 600, the inlet flow path 700, and the check valve assembly 400.

The pump 500 may include a pump housing 510 for accommodating pump parts, a piston 580 for changing the pressure in the space S2 of the first check valve housing through the forward/rearward movement, a cylinder 590 forming a space for the piston to move forward and rearward, a motor 520 for generating power, a first gear 530 rotated by the motor 520, a second gear 540 rotating in engagement with the first gear, a third gear 550 rotates with the second gear 540, a crank gear 560 rotates in engagement with the third gear, and a connecting rod 570 connecting the crank gear and the piston.

The piston 580 may perform reciprocating motion in a direction parallel to the direction in which the plurality of cartridges 200 are arranged, and the motor 520 may have a drive shaft disposed parallel to the direction in which the piston 580 performs reciprocating motion.

For example, the cartridge 200 is formed long in the front-rear direction of the washing machine, a plurality of cartridges may be installed in a line in the left-right direction of the washing machine, and the piston 580 can perform reciprocating motion in the left-right direction of the washing machine. In addition, the motor 520 may be arranged such that the drive shaft is aligned in the left-right direction.

The first gear 530 may be coupled to the drive shaft of the motor 520 and may rotate integrally with the drive shaft. The first gear 530 may be formed of a helical gear. Through the helical gear, noise from the motor 520 can be reduced, and power transmission can be easily performed. The second gear 540 may be formed of a worm gear. Since the pump 500 is located between configurations such as the inlet flow path 700, the outlet flow path pipe 800, and the flow path switching valve 600, it is necessary to dispose the assembly accommodation space as densely as possible for efficient use of space. Therefore, according to the embodiment of the present disclosure, the motor 520 is laid down and the second gear 540 is formed of a worm gear so that the rotational power direction can be switched and transmitted.

The second gear 540 and the third gear 550 rotate together. The crank gear 560 rotates in engagement with the third gear 550. The number of gear teeth of the crank gear is formed much more than the number of gear teeth of the third gear 550, so that a stronger force can be transmitted due to the gear ratio during the reciprocating motion of the piston 580.

The crank gear 560 includes a crank shaft 561 forming a rotation axis of the crank gear, a crank arm 562 extended from the crank shaft, and a crank pin 563 connected to a connecting rod 570. The crank pin 563 and the connecting rod 570 are rotatably coupled, and when the crank gear 560 rotates, as the crank pin 563 rotates, the connecting rod 570 may move linearly in the direction that the cylinder 590 forms.

The connecting rod 570 is coupled to the piston 580, and the piston 580 is inserted into the cylinder 590 and can reciprocate in the longitudinal direction of the cylinder 590. Through the linear motion of the piston 580, positive or negative pressure may be transmitted to the flow path switching valve 600 connected to the cylinder 590. When the piston moves in the direction of the flow path switching valve 600, positive pressure is transmitted to the flow path switching valve 600, and when the piston moves in the opposite direction of the flow path switching valve 600, negative pressure is transmitted to the flow path switching valve 600.

Hereinafter, the flow path switching valve 600 will be described with reference to FIGS. 5 to 8, 12, 14 and 15.

The flow path switching valve 600 is connected to the pump 500 and the inlet flow path 700. The flow path switching valve 600 selectively communicates the cylinder 590 of the pump 500 with any one flow path 700 (e.g. 700*a*) of the plurality of flow paths of the inlet flow path 700.

As described later, a first outlet flow path pipe 800*a* and a second outlet flow path pipe 800*b* may be disposed to be spaced apart from each other in a direction in which the plurality of cartridges 200 are arranged. The flow path switching valve 600 may be disposed between a gap where the first and second outlet flow paths 800*a* and 800*b* are spaced apart.

The flow path switching valve 600 includes a first housing 610 connected to the cylinder 590 of the pump 500, a second housing 650 coupled with the first housing, a disk 620 rotatably disposed in a space formed by the first housing 610 and the second housing, a spring valve 630 installed in the disk 620, a flow path switching motor 670 for rotating the disc, a shaft 640 for transmitting the rotational force of the flow path switching motor 670 to the disk 620, a micro switch 660 for inputting the rotational position of the disk 620 to the controller 3, and a plane cam 645 that rotates with the shaft 640 and opens and closes the current flowing through the micro switch 660.

The first housing 610 may form an upper outer shape of the flow path switching valve 600, and the second housing 650 may form a lower outer shape of the flow path switching valve 600. Accordingly, the first housing 610 may be referred to as an upper housing 610, and the second housing 650 may be referred to as a lower housing 650.

The spring valve 630 includes a spring 631 that provides elastic force, a spring shaft 632 that prevents the spring 631 from being separated, and a plug part 633 that can block a flow path connection hole 651*a* by the elastic force of the spring.

The disk 620 is provided with an insertion hole 621 into which the spring shaft 632 is inserted so as to fix the position of the spring valve, and a disk hole 622 through which the fluid passes. The fluid introduced into the flow path switching valve 600 may pass through the disk 620 through the disk hole 622, and may partially pass through the insertion hole 621.

In another embodiment of the present disclosure, a water supply port 615 (see FIGS. 19, 21A, and 21B) is formed in the first housing 610 to be connected to the water supply valve 830.

The second housing 650 is provided with a plurality of inlet connection ports 653*a*, 653*b*, 653*c*, 653*d*, 653*e*, 653*f* (hereinafter, 653) coupled to a plurality of flow paths of the inlet flow path 700, and a plurality of flow path connection holes 651*a*, 651*b*, 651*c*, 651*d*, 651*e*, 651*f* (hereinafter, 651) communicating with a plurality of inlet connection port 653 respectively. The fluid that passed through the disk hole 622 and the insertion hole 621 of the disk 620 may pass through each inlet connection port 653 through the flow path connection hole 651 and then may be supplied to each inlet flow path 700 connected to the inlet connection port 653.

The spring valve 630 may selectively open and close some of the plurality of flow path connection holes 651. When the disk 620 rotates and the spring valve 630 closes some of the plurality of flow path connection holes 651, the other may be opened.

In order to supply a plurality of additive, a plurality of flow path connection holes 651*a* may be opened, and a plurality of spring valves 630 may also be formed to block a plurality of flow path connection holes.

The spring valve 630 may be provided in a smaller number than the plurality of flow path connection holes 651, and preferably, may be provided in one less number than the number of the plurality of flow path connection holes 651. That is, the spring valve 630 may be provided in one less number than the number of the plurality of cartridges. In this case, one flow path connection hole 651 (e.g. 651*a*) may be opened, and the other flow path connection holes 651 (e.g. 651*b* to 651*f*) may be closed. Accordingly, the additive may be extracted from the cartridge 200*a* and discharged into the outlet flow path pipe 800 by changing the pressure of the space S2 formed in the check valve assembly 400*a* connected to one cartridge (e.g. 200*a*) of the plurality of cartridges 200.

When the additive to be supplied is selected, power is supplied to the flow path switching motor 670 to be driven. The driven flow path switching motor 670 rotates the shaft 640 connected thereto and the disk 620 connected to the shaft 640.

At this time, the spring valve 630 installed in the disk 620 can also rotate together according to the rotation of the disk. When the flow path connection hole 651 of the lower housing 650 is located in the rotational position of the spring valve 630, the flow path connection hole 651 may be blocked by the plug part 633 due to the elastic force of the spring 631.

In order to connect the pump 500 and the check valve assembly 400*a* connected to the cartridge 200*a* containing the additive to be supplied, the controller 3 may control the rotation angle of the disk 620 so that the spring valve 630 is not located in the flow path connection hole 651*a* connected to the check valve assembly 400*a*.

If the spring valve 630 is not located in the flow path connection hole 651*a*, the pump 500 and the flow path connection hole 651*a* are opened, and positive or negative pressure generated in the pump 500 is sequentially transmitted to the inlet flow path 700*a* and the check valve assembly 400*a* through the flow path connection hole 651*a*, so that the additive of the cartridge 200 can be supplied to the outlet flow path pipe 800.

In addition, in order to block the pump 500 and the check valve assembly 400*a* connected to the cartridge containing the additive that do not need to be supplied, the spring valve 630 is located in the flow path connection hole 651*a* connected to the check valve assembly 400*a*, and the rotation angle of the disk can be controlled so that the plug part 633 blocks the flow path connection hole 651*a* due to the elastic force of the spring 631.

When the spring valve 630 is located in the flow path connection hole 651*a*, the pump 500 and the flow path connection hole 651*a* are blocked, and positive or negative pressure generated in the pump 500 is not transmitted to the check valve assembly 400*a*, so that the additive of the cartridge 200 does not flow.

When the spring valve 630 of the disk 620 is not in the position of the flow path connection hole 651*a*, the spring valve 630 is located while being compressed in a lower housing upper surface 652, and then, when the spring valve 630 moves to the position of the flow path connection hole 651*a* through the rotation of the disk 620, the spring valve 630 is tensioned to block the flow path connection hole 651*a*.

In order to accurately control the rotation angle of the disk 620, the flow path switching valve 600 includes a micro switch 660 and a plane cam 645. The plane cam 645 may be integrally formed with the shaft 640 or coupled to the shaft 640 to rotate integrally with the shaft 640 and the disk 620.

The micro switch 660 includes an actuator, and an electric circuit can be changed by the movement of the actuator.

A cam is a device having a special contour (or groove) that performs a rotation movement (or reciprocating motion), and the plane cam 645 is a type of the cam, and refers to a contour indicating a plane curve.

Figure 8:
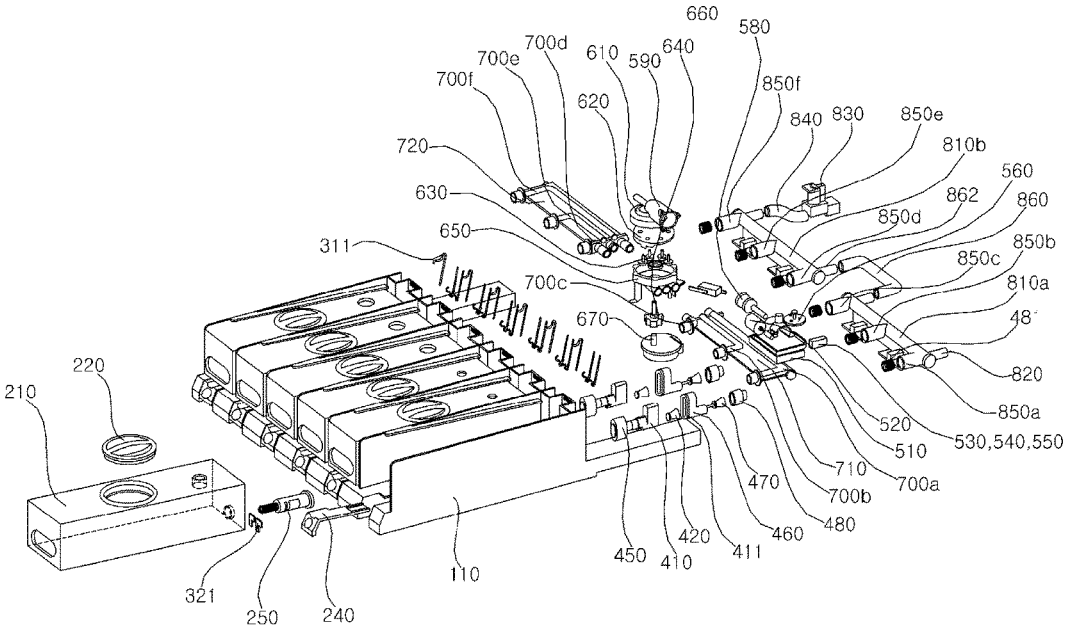
FIG. 8 is an exploded perspective view of the detergent supply device shown in FIG. 5.
Figure 9:
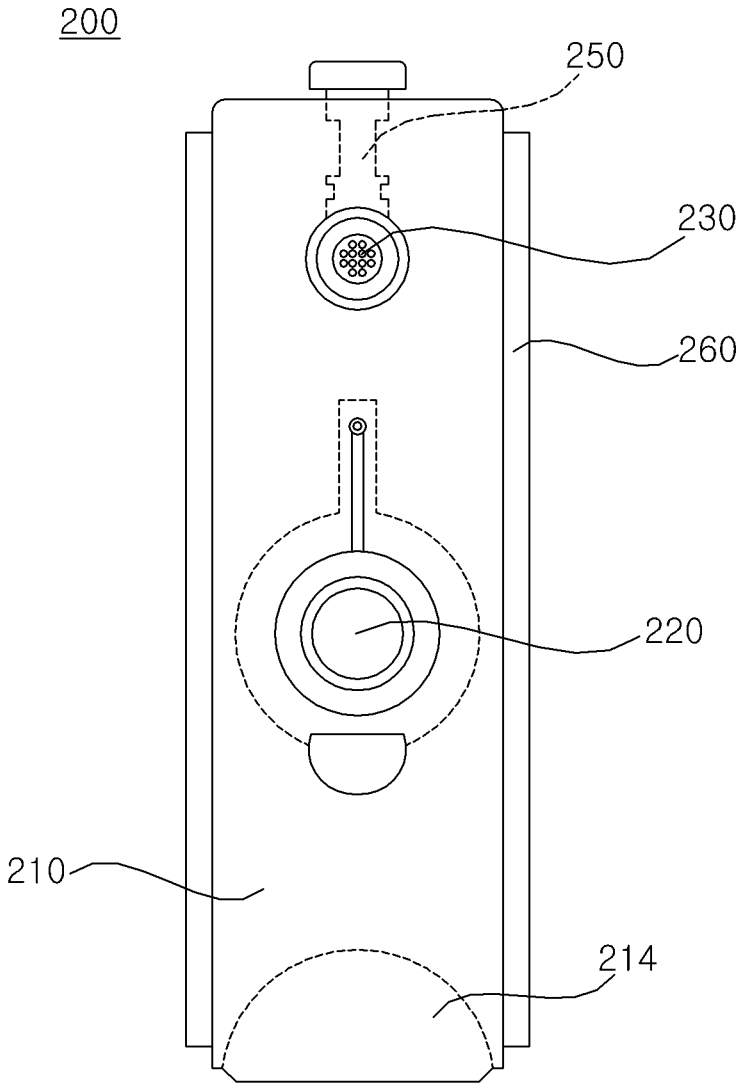
FIG. 9 is a plan view of a cartridge shown in FIG. 7.
Figure 10:
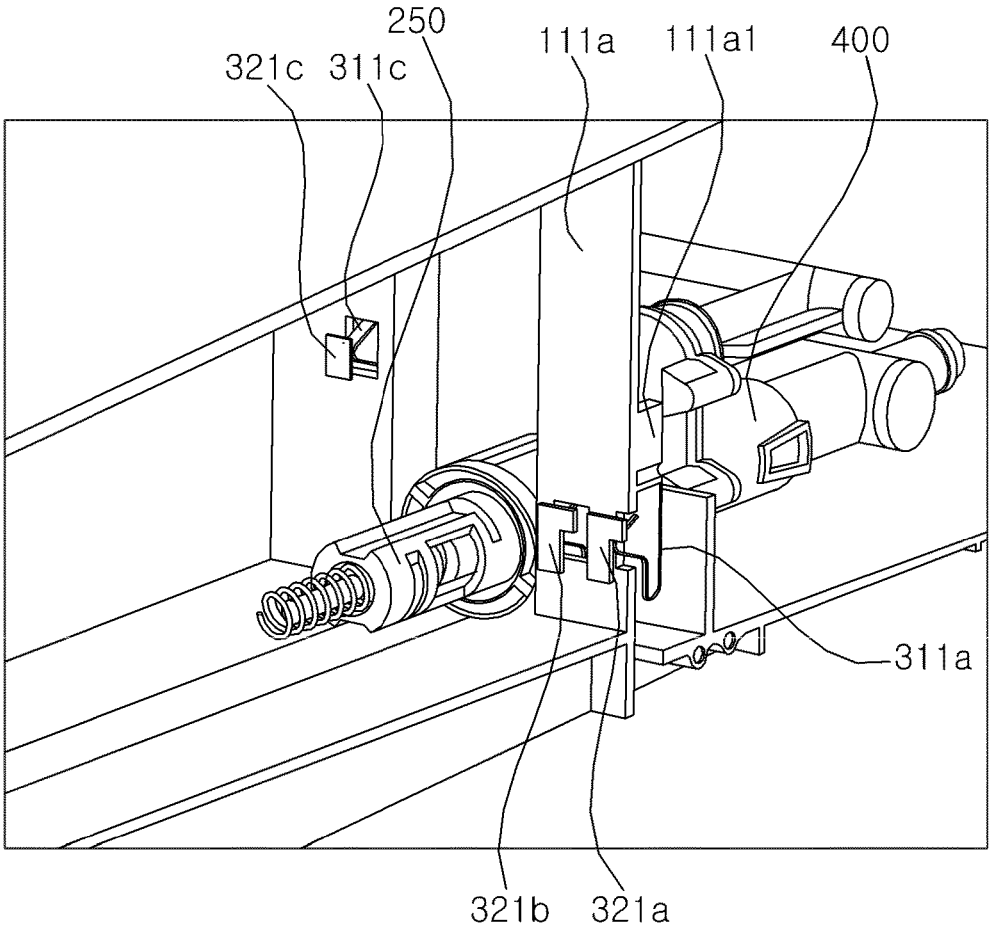
FIG. 10 is a view showing a docking valve, a check valve assembly, and an electrode sensor shown in FIG. 8.
Figure 12:
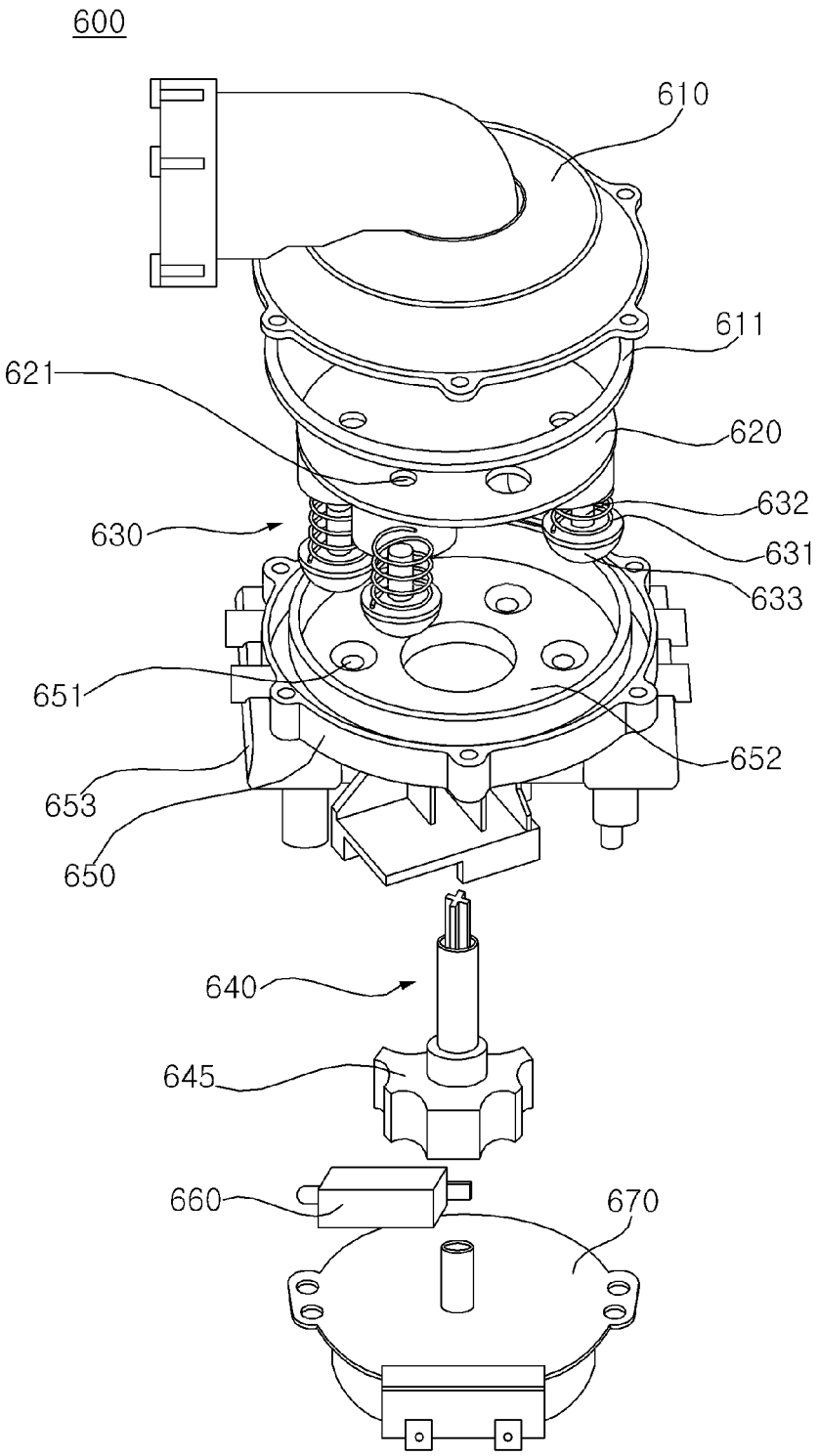
FIG. 12 is an exploded perspective view of a flow path switching valve shown in FIG. 8.
Figure 13:
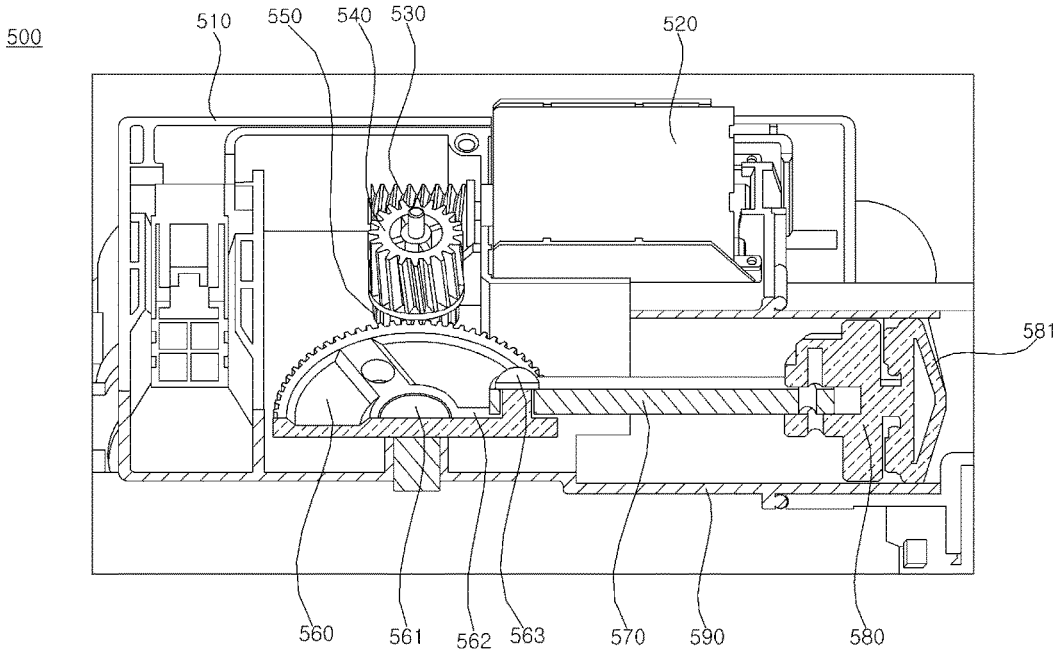
FIG. 13 is a view showing a pump shown in FIG. 8.
Figure 14:
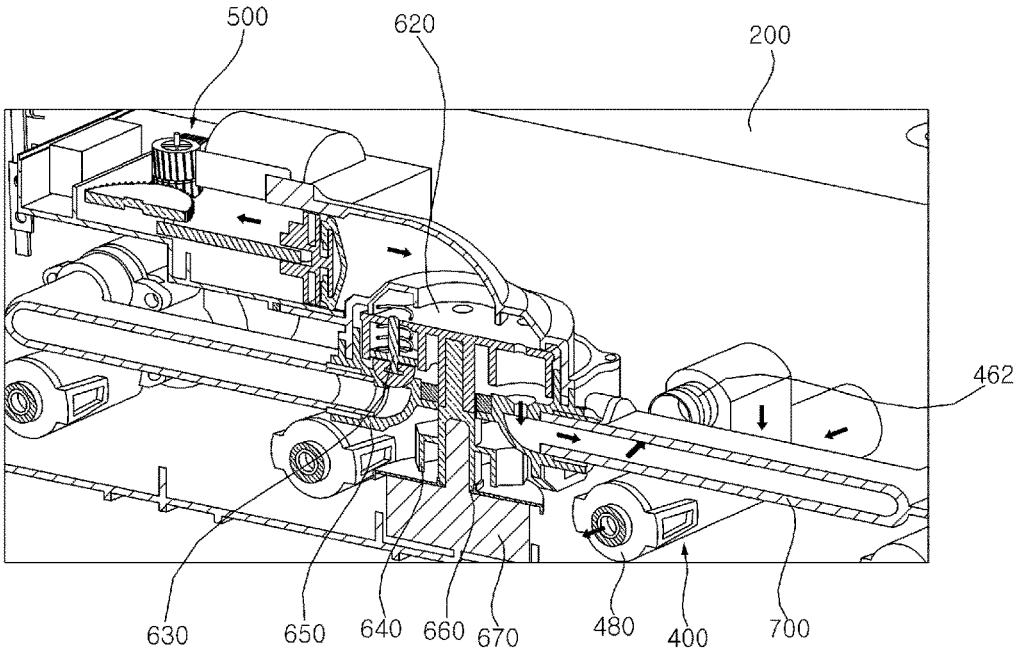
FIG. 14 is a view showing that the pressure changed through a flow path switching valve is transmitted according to the drive of the pump shown in FIG. 8.
Figure 15:
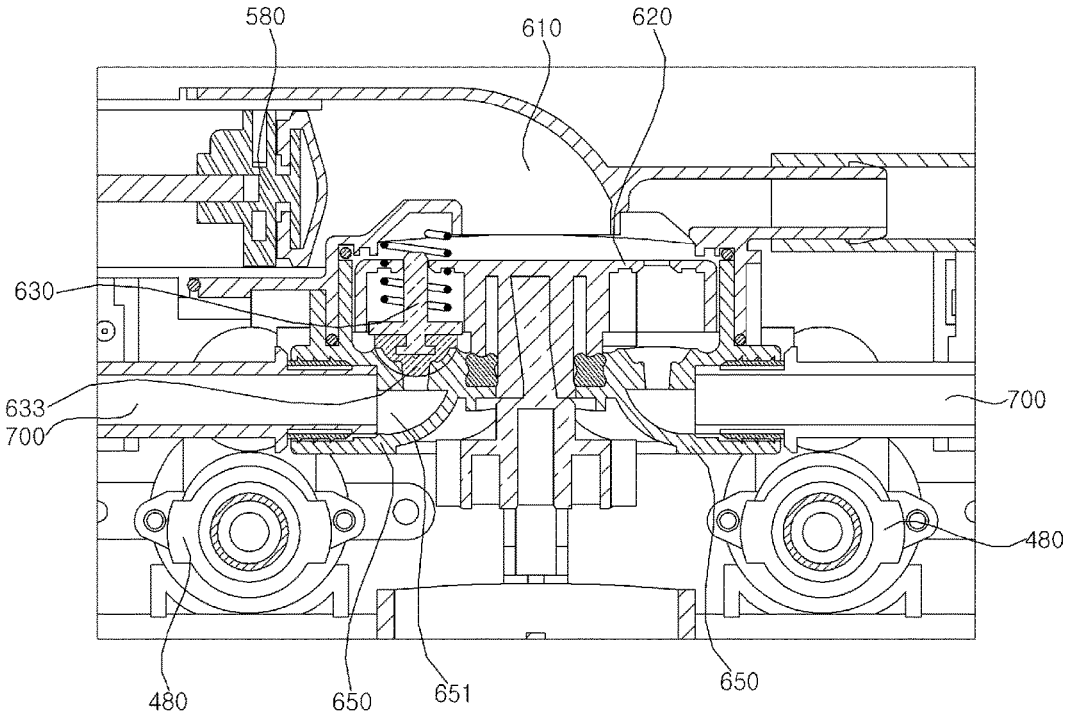
FIG. 15 is a cross-sectional view of a flow path switching valve.

Referring to FIGS. 8 and 12, the plane cam 645 forms a special contour by having a plurality of protrusion portions having different shapes and a separation distance, and as the plane cam 645 rotates, the protrusion portion can open and close the current by pressing the actuator provided in the micro switch 660. The controller 3 may determine and control the rotational position of the disk 620 due to a pattern in which the current is opened and closed.

The plane cam 645 and the shaft 640 rotate in combination with the drive shaft of the flow path switching motor, and the micro switch 660 is disposed such that the actuator contacts the plane cam 645. In an embodiment of the present disclosure, the flow path switching motor 670 is disposed below the lower housing 650, and the plane cam 645 and the micro switch 660 may be located between the flow path switching motor 670 and the lower housing 650.

Hereinafter, the inlet flow path 700 will be described with reference to FIGS. 5 to 8.

The detergent supply device 100 includes an inlet flow path 700 that transmits the pressure change generated by the reciprocating motion of the piston 580 to the space S2 formed in the plurality of check valve assemblies 400. The inlet flow path 700 includes a plurality of flow paths 700*a*, 700*b*, 700*c*, 700*d*, 700*e*, 700*f* (hereinafter, 700*a*) communicating with the space S2 formed in the plurality of check valve assemblies 400 respectively.

The check valve assembly 400 of the inlet flow path 700 is connected to the flow path connection portion 461, and is connected to the inlet connection port 653 of the flow path switching valve 600 to transmit the flow of the fluid transmitted through the pump 500 to the check valve assembly 400.

The plurality of flow paths 700*a* are connected to a plurality of inlet flow path connection portions 461*a*, 461*b*, 461*c*, 461*d*, 461*e*, 461*f*, and inlet connection ports 653*a*, 653*b*, 653*c*, 653*d*, 653*e*, 653*f* respectively.

The inlet flow path 700 may include a first inlet flow path having a portion 700*a*, 700*b*, 700*c* of the plurality of flow paths 700*a*, 700*b*, 700*c*, 700*d*, 700*e*, 700*f*, and a second inlet flow path having a remaining portion 700*d*, 700*e*, 700*f* of the plurality of flow paths 700*a*, 700*b*, 700*c*, 700*d*, 700*e*, 700*f*.

Meanwhile, three cartridges 200 and a check valve assembly 400 connected thereto may be disposed respectively in the left and right sides, and the flow path switching valve 600 may be located in the center of the rear side of the cartridge.

The first inlet flow path 710 and the second inlet flow path 720 may be coupled with the flow path switching valve 600, and may be symmetrically coupled with respect to a straight line passing through the center of the flow path switching valve 600.

The flow path 700*a*, 700*b*, 700*c* provided in the first inlet flow path 710 may be respectively connected to the inlet flow path connection portion 461*a*, 461*b*, 461*c* of the left check valve assembly 400*a*, 400*b*, 400*c* and the flow path discharge holes 653*a*, 653*b*, 653*c* formed side by side in the left side of the flow path switching valve 600.

The flow path 700*d*, 700*e*, 700*f* provided in the second inlet flow path 720 may be respectively connected to the inlet flow path connection portion 461*d*, 461*e*, 461*f* of the right check valve assembly 400*d*, 400*e*, 400*f*, and the flow path discharge hole 653*d*, 653*e*, 653*f* formed side by side in the right side of the flow path switching valve 600.

The first inlet flow path 710 is integrally formed through a first flow path plate 715 to fix a plurality of flow paths 700*a*, 700*b*, 700*c*, and the second inlet flow path 720 is integrally formed through a second flow path plate 725 to fix a plurality of flow paths 700*d*, 700*e*, 700*f*, thereby stably supplying the fluid.

Hereinafter, the outlet flow path pipe 800 will be described with reference to FIGS. 5 to 8.

Figure 5:
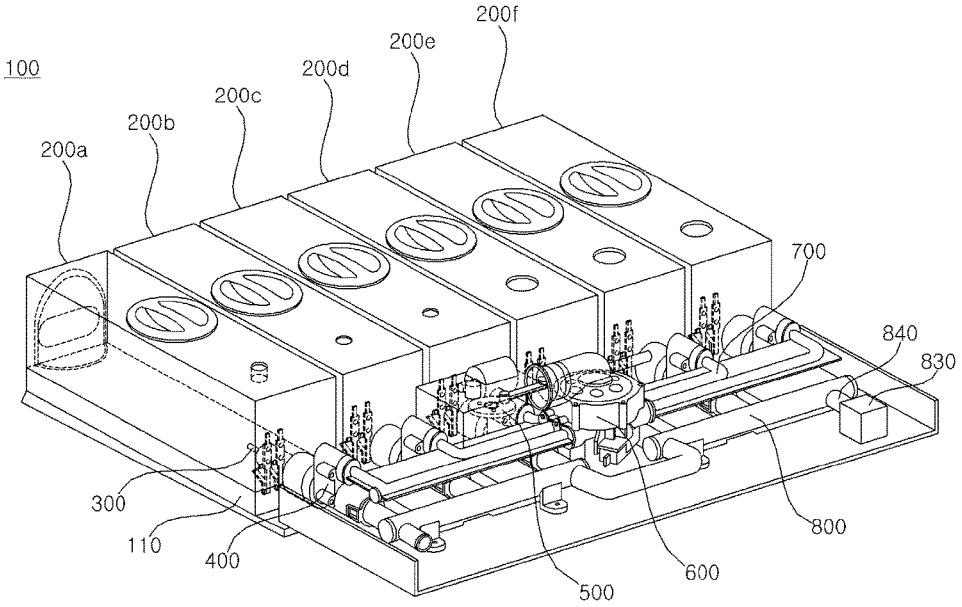
FIG. 5 is a perspective view of a detergent supply device of a washing machine according to an embodiment of the present disclosure.
Figure 6:
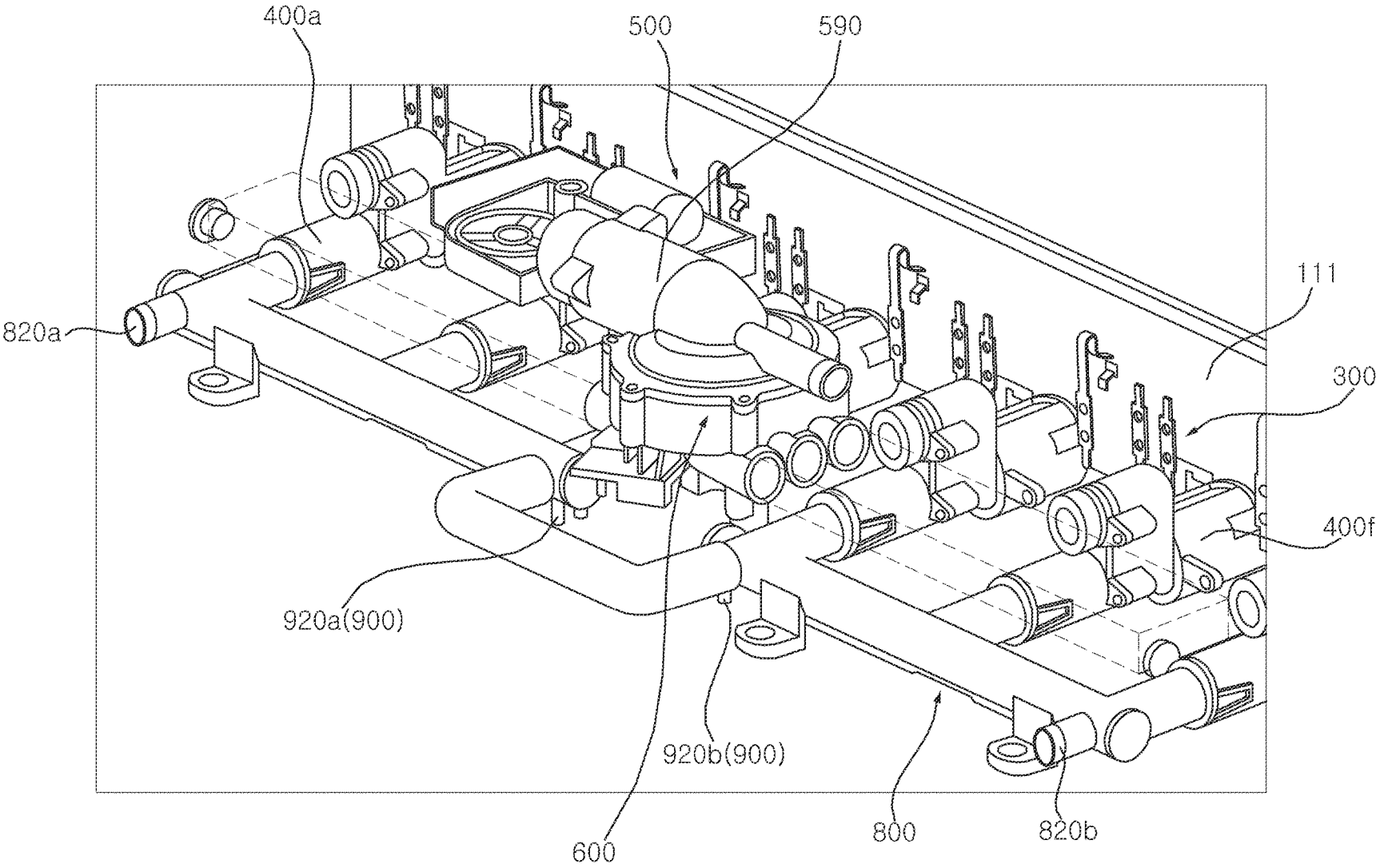
FIG. 6 is a perspective view of another angle of the detergent supply device shown in FIG. 5.
Figure 7:
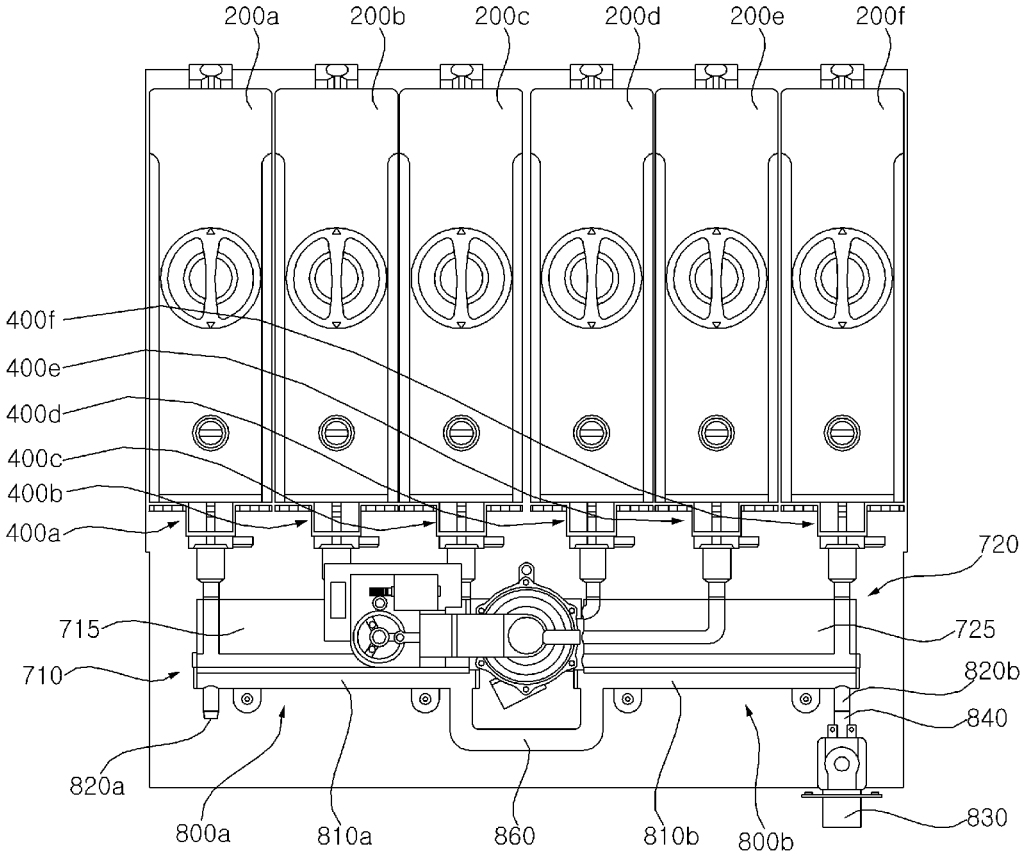
FIG. 7 is a plan view of a washing machine according to an embodiment of the present disclosure.

The detergent supply device 100 includes an outlet flow path pipe 800 through which an additive extracted from the cartridge 200 flows toward the tub 31. The outlet flow path pipe 800 is connected to the cartridge 200. The fact that the outlet flow path pipe 800 is connected to the cartridge 200 means to include not only the case where the cartridge 200 and the outlet flow path pipe 800 are directly connected, but also the case where as shown in FIG. 5, the check valve assembly 400 is disposed between the cartridge 200 and the outlet flow path pipe 800 such that the cartridge and the outlet flow path pipe are connected through the check valve assembly 400.

In the outlet flow path pipe 800, the additive extracted from the cartridge 200 and the water supplied from the water supply valve 830 flow.

The outlet flow path pipe 800 may include an inflow port 850*a*, 850*b*, 850*c*, 850*d*, 850*e*, 850*f* (hereinafter, 850) respectively connected to the plurality of check valve assemblies 400, a joint pipe 810*a*, 810*b* which forms a flow path communicating with a plurality of inflow ports 850, and through which the water supplied from the water supply valve 830 and the additive extracted from the cartridge 200 flow, and a discharge port 820*a* which communicates with the flow path of the joint pipe 810*a*, 810*b*, is connected to the tub 31, and discharges the water and additive. In addition, the outlet flow path pipe 800 may include a water supply port 820*b* which is connected to the water supply valve 830, through which the water supplied from the water supply valve 830 is introduced, and which communicates with the flow path of the joint pipe 810*a*, 810*b*.

The outlet flow path pipe 800 is connected to the outlet flow path connection pipe 481 of the check valve assembly 400, so that the additive discharged through the outlet flow path connection pipe 481 may be supplied to the tub 31 or the drawer 39 through the discharge port 820.

The detergent supply device 100 includes a water supply valve 830 receiving water from an external water source, and the water supply valve 830 may be connected to the water supply port 820*b* through the water supply hose 840. The water supplied through the water supply valve 830 passes through the water supply hose 840 and is guided to the outlet flow path pipe 800.

The guided water flows along the joint pipe 810*a*, 810*b* toward the discharge port 820*a* located in the opposite side of the water supply port 820*b*, dilutes the additive that is supplied through the inflow port 850 and enters the outlet flow path pipe 800, and discharged to the discharge port 820*b* together with the water.

The joint pipe 810 is a straight pipe, and may form a straight flow path therein. The plurality of cartridges 200 may be disposed in parallel with each other, and the joint pipe 810 may be extended in a direction parallel to the direction in which the plurality of cartridges 200 are arranged. For example, referring to FIGS. 2 and 5, the plurality of cartridges 200 are arranged in parallel in the left and right direction, and the outlet flow path pipe 800 is a straight pipe extended in the left and right direction, and may form a straight flow path therein in the left and right direction.

The joint pipe 810 is provided with a hole communicating with the inflow port 850, the discharge port 820*a*, the water supply port 820*b*, and the connection port 860, and the above mentioned ports may protrude from the joint pipe.

The inflow port 850 may protrude toward the cartridge from the joint pipe 810*a*, 810*b* (e.g., toward the front), and the discharge port 820*a* and the water supply port 820*b* may protrude rearward from the joint pipe 810*a*, 810*b*.

The inflow port 850 is connected to each outlet flow path connection pipe 480, and the additive discharged from the outlet flow path connection pipe 480 may be introduced into the outlet flow path pipe 800 through the inflow port 850.

The outlet flow path pipe 800 may include a first outlet flow path pipe 800*a*, a second outlet flow path pipe 800*b*, and a connection hose 860 connecting the first outlet flow path pipe 800*a* and the second outlet flow path pipe 800*b*.

The first outlet flow path pipe 800*a* may include a portion 850*a*, 850*b*, 850*c* of the plurality of inflow ports, a discharge port 820*a*, and a first joint pipe 810*a* in which a flow path communicating with them is formed. The second outlet flow path pipe 800*b* may include the remaining portions 850*d*, 850*e*, 850*f* of the plurality of inflow ports, a water supply port 820*b*, and a second joint pipe 810*b* in which a flow path communicating with them is formed.

The first outlet flow path pipe 800*a* may include a first connection port 861 communicating with the first joint pipe 810*a*, and the second outlet flow path pipe 800*b* may include a second connection port 862 communicating with the second joint pipe 810*b*. The connection hose 860 may be connected to the first connection port 861 and the second connection port 862.

The first outlet flow path pipe 800*a* and the second outlet flow path pipe 800*b* are disposed to be spaced apart from each other in a direction in which a plurality of cartridges 200 are arranged (e.g. in the left and right direction of washing machine), so that the flow path switching valve 600 may be disposed in a spaced portion between the first and second outlet flow path pipes 800*a* and 800*b*.

In order to prevent the interference between the outlet flow path pipe 800 and the flow path switching valve 600 as much as possible, the connection hose 860 is bent and installed in a u-shape to secure an installation space of the flow path switching valve 600.

Hereinafter, the flow path pipe sensor 900 will be described with reference to FIGS. 4, 17, 18A, and 18B.

The detergent supply device 100 of a washing machine according to an embodiment of the present invention includes a flow path pipe sensor 900 that detects an existence of additive in the outlet flow path pipe 800. The flow path pipe sensor 900 is an electrode sensor, and may output a signal when two electrodes spaced apart from each other, which are positive (+) and negative (−) poles, are conducted through a medium. The flow path pipe sensor 900 may be installed in the outlet flow path pipe 800.

The flow path pipe sensor 900 may include a rod electrode 910 disposed in a flow path inside the outlet flow path pipe 800, and an electrode terminal 920 that is bent from the rod electrode 910 and protrudes to the outside of the outlet flow path pipe 800.

The rod electrode 910 may be extended in a direction parallel to the joint pipe 810 of the outlet flow path pipe 800. The rod electrode 910 may be extended in a direction parallel to the flow path inside the outlet flow path pipe 800, i.e. to the straight flow path inside the joint pipe 810. The rod electrode 910 may be extended from the port formed closest to one end of the joint pipe 810 among at least the inflow port 850, the discharge port 820*a*, the water supply port 820*b*, and the connection port 861, 862 protruded from the joint pipe 810 to the port formed closest to the other end.

Figure 18A:
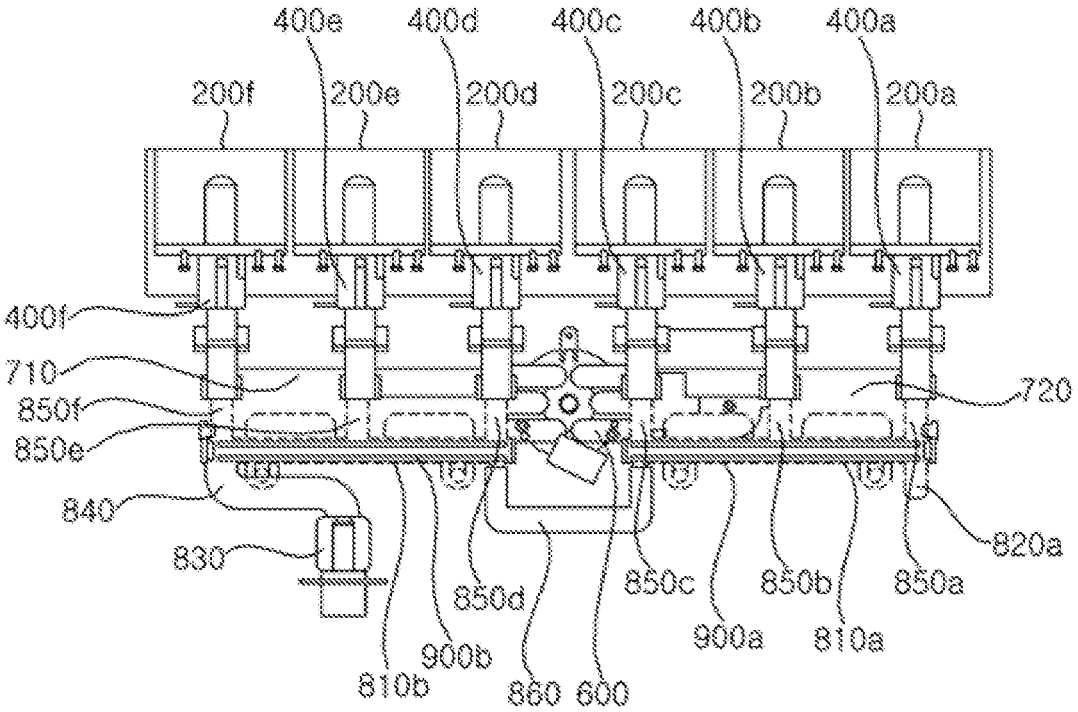
FIGS. 18A and 18B are a bottom view and a perspective view of the detergent supply device shown in FIG. 6, and shows a rod electrode and an electrode terminal of a flow path pipe sensor.
Figure 18B:
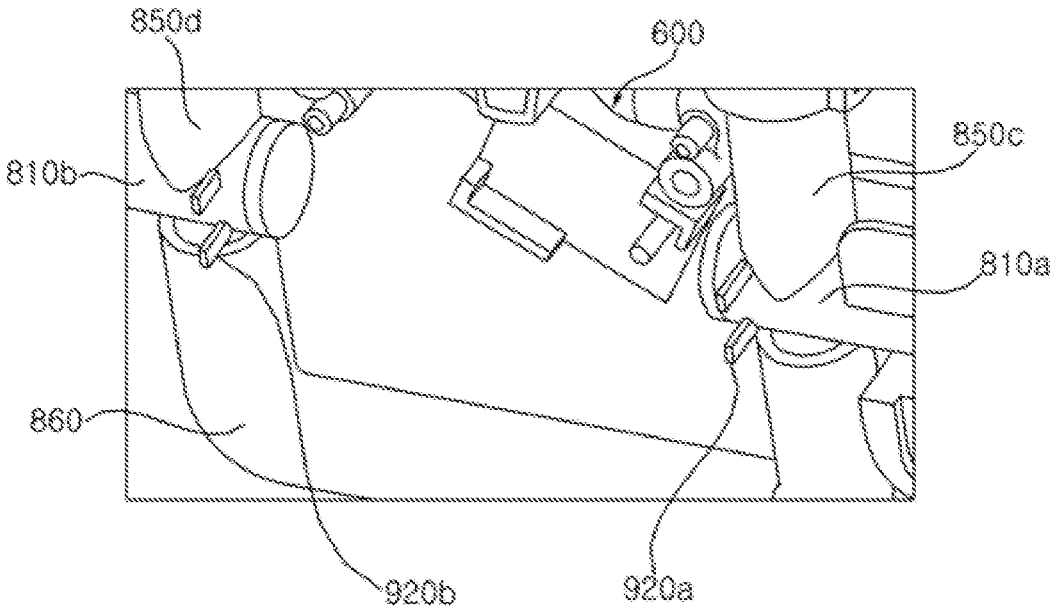

For example, referring to FIG. 18A, the port formed closest to one end of the first joint pipe 810*a* is the discharge port 820*a* and the first inflow port 850*a*, and the port formed closest to the other end is the first connection port 861 and the third inflow port 850*c*. In the first rod electrode 910*a* installed in the first joint pipe 810*a*, one end is disposed in a portion where the first inflow port 850*a* of the first joint pipe 810*a* and the discharge port 820*a* are formed, and the other end is disposed in a portion where the third inflow port 850*c* of the first joint pipe 810*a* and the first connection port 861 are formed. In the drawing, the first and third inflow ports 850*a* and 850*c*, the first connection port 861, and the discharge port 820*a* are formed in both ends of the joint pipe 810*a*. However, when the ports of the outlet flow path 800 are disposed to be spaced apart from the distal end of the joint pipe, the distal end of the rod electrode 910 may be disposed closer to the end of the joint pipe 810 than these ports.

In such a structure, even if the outlet flow path pipe 800 is blocked in a certain part of the joint pipe 810 due to the solidification of the additive, the flow path pipe sensor 900 can detect that the outlet flow path pipe is blocked.

When the additive remains inside the outlet flow path pipe 800, the additive may remain below the flow path due to gravity. Therefore, the rod electrode 910 is disposed inside the outlet flow path pipe, and is disposed in the lower side of the flow path, so that the additive does not completely block the flow path. Further, even when the additive is solidified in the lower side, it is possible to detect whether the additive is remained.

The electrode terminal 920 may be bent from any one end of both ends of the rod electrode 910, and protrude to the outside of the outlet flow path. By protruding the electrode terminal 920 to the outside, the flow path pipe sensor can be connected to the controller 3 and a power source.

The flow path pipe sensor 900 is formed of a conductive material as an electrode sensor, and the outlet flow path pipe 800 is formed of a non-conductive material and should not leak. Therefore, the flow path pipe sensor 900 can be installed in the outlet flow path pipe 800 by an insert injection method in which the flow path pipe sensor 900 is inserted while manufacturing the outlet flow path pipe 800.

Alternatively, a hole is formed in any one end of the joint pipe 810, and the electrode terminal 920 has an insertion hole formed in the lower portion of the joint pipe 810. Thus, the flow path pipe sensor 900 is disposed in the outlet flow path pipe 800 through the hole, the electrode terminal 920 is inserted into the insertion hole, and then, the insertion hole is sealed, and the flow path pipe sensor 900 may be installed in the outlet flow path pipe 800 by closing the hole with a plug or the like.

The flow path pipe sensor 900 may be installed in the outlet flow path by other known methods.

The flow path pipe sensor 900 may include a pair of rod electrode 910 disposed side by side with each other, and a pair of electrode terminals 920 bent from the pair of rod electrode 910, respectively. The pair of rod electrodes 910 are spaced apart from each other, and the pair of electrode terminals 920 are also spaced apart from each other.

The pair of electrode terminals 920 may protrude to the outside of the outlet flow path pipe 800, be connected to the controller 3, and may be applied with a voltage. Any one electrode terminal 920 of the pair of electrode terminals 920 may be connected to a positive (+) pole, and the other electrode terminal 920 may be connected to a negative (−) pole.

The outlet flow path pipe 800 may include a first outlet flow path pipe 800*a* and a second outlet flow path pipe 800*a*. The flow path pipe sensor 900 may include a flow path pipe sensor 900*a* installed in the first outlet flow path pipe 800*a* and a second flow path pipe sensor 900*b* installed in the second outlet flow path pipe 800*b*.

The first flow path pipe sensor 900*a* may include a first rod electrode 910*a* disposed in an inner flow path of the first joint pipe 810*a*, and a first electrode terminal 920*a* which is bent from the first rod electrode 910*a* and protrudes to the outside of the first joint pipe 810*a*. The second flow path pipe sensor 900*b* may include a second rod electrode 910*b* disposed in an inner flow path of the second joint pipe 810*b*, and a second electrode terminal 920*b* which is bent from the second rod electrode 910*b* and protrudes to the outside of the second joint pipe 810*b*.

The first and second flow path pipe sensors 900*a* and 900*b* have the same characteristics as the flow path pipe sensor 900 described above, respectively. Accordingly, the first rod electrode 910*a*, the second rod electrode 910*b*, the first electrode terminal 920*a*, and the second electrode terminal 920*b* may be provided in a pair respectively.

As described above, the first outlet flow path pipe 800*a* and the second outlet flow path pipe 800*b* are disposed to be spaced apart from each other, and the flow path switching valve 600 may be disposed between a spaced portion. The first electrode terminal 920*a* is formed by bending from the distal end of the second outlet flow path pipe 800*b* side of the first rod electrode 910*a*, and the second electrode terminal 920*b* may be formed by bending from the distal end of the first outlet flow path 800*a* side of the second rod electrode 910*b*. With this structure, the length of the wire connected to the first and second flow path pipe sensors 900*a* and 900*b* can be reduced.

Meanwhile, the pair of electrode terminals 920 are connected to the positive (+) and negative (−) poles of the power source respectively, and when a pair of rod electrodes 910 extended from the pair of electrode terminals 920 are electrically connected to form a closed circuit.

When there is air or water in the flow path in the joint pipe 810, a current may not flow between the pair of rod electrodes 910, or only a minute current may flow. A signal, i.e. the above described additive no-detection data, that is generated in this case is stored in the memory 4.

When water in which the additive is diluted exists in the flow path inside the joint pipe, or when the additive is solidified to connect the pair of rod electrodes 910, the additive contains ion, so that current flows between the pair of rod electrodes 910, and a closed circuit is formed.

Therefore, when the first signal input from the flow path pipe sensor 900 before extracting the additive is the same as the additive no-detection data, the controller may determine that the outlet flow path pipe 800 is in a normal state. If it is different, the controller may determine that the outlet flow path 800 is occluded due to the additive.

Meanwhile, after transmitting the operation signal to the pump 500, after a preset time for the pump 500 to extract the additive is elapsed, when the second signal input from the flow path pipe sensor 900 is different from the additive no-detection data, the controller may determine that it is a normal state in which the additive is extracted to the outlet flow path pipe 800. If it is the same, it can be determined that the additive is not extracted, and the pump 500 has a problem. The preset time is stored in the memory 4 depending on the washing course and the amount of laundry accommodated in the washing machine.

Hereinafter, a water supply valve of a washing machine according to an embodiment of the present disclosure will be described with reference to FIGS. 5 to 8, 20A, and 20B.

The water supply valve 830 of the washing machine according to an embodiment of the present disclosure is connected to the water supply port 820*b* provided in the outlet flow path pipe 800 to supply water to the outlet flow path pipe 800. The water supply valve 830 and the water supply port 820*b* are connected through the water supply hose 840. However, since the water supply valve 830 is not connected to the outlet flow path through the flow path switching valve 600, the inlet flow path 700, the check valve assembly 400, etc. it can be said that the water supply valve and the outlet path are directly connected.

The washing machine according to an embodiment of the present disclosure uses air as a fluid for driving the first and second check valves 420 and 470. The cylinder 590, the inlet flow path 700 are filled with air, and the air flows through the space S2 formed in the cylinder 590, the inlet flow path 700, and the check valve assembly 400 due to the reciprocating motion of the piston 580. Accordingly, the changed pressure is transmitted to the space S2 formed in the check valve assembly 400.

Figure 20A:
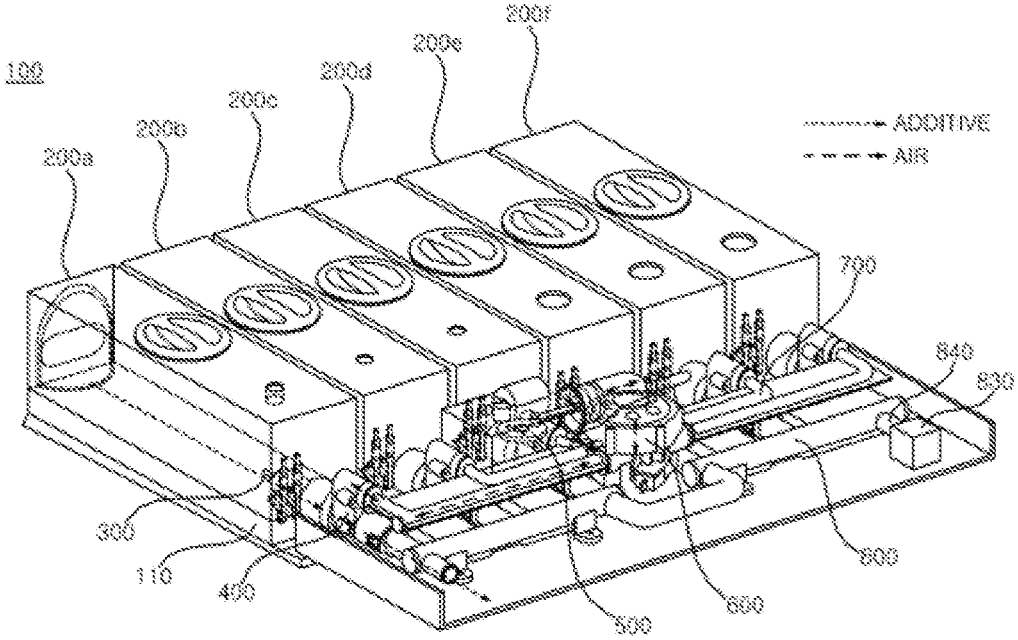
FIGS. 20A and 20B are views showing that additive, air, and water flow according to the driving of a pump of a washing machine according to an embodiment of the present disclosure.
Figure 20B:
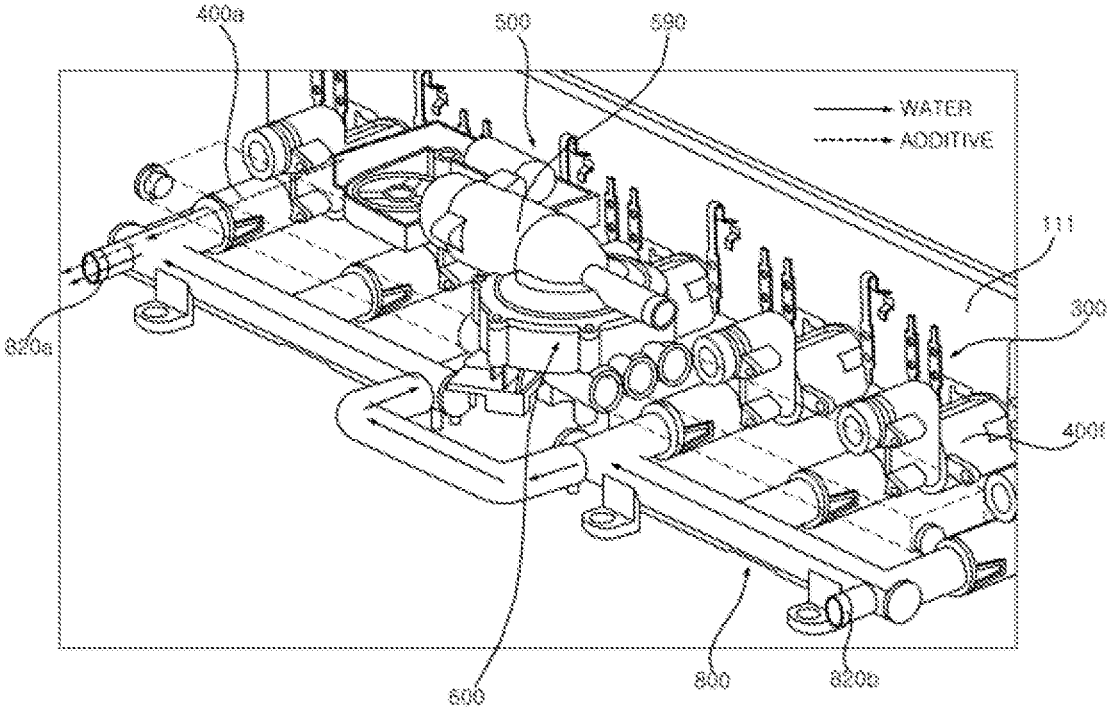

Referring to FIGS. 20A and 20B, a flow path 700*a* communicating with the cylinder, among the plurality of flow paths of the inlet flow path 700 by the flow path switching valve 600. The space S2 formed in a check valve assembly 400*a* among the plurality of the check valve assemblies 400 is communicated with the flow path 700*a*. The pressure change due to the reciprocating motion of the piston 580 is transmitted to the space S2 formed in the check valve assembly 400*a*. Therefore, the additive may be extracted from the cartridge 200*a* and discharged to the outlet flow path pipe 800.

When the additive is discharged to the outlet flow path pipe 800, the controller 3 opens the water supply valve 830 to supply water to the outlet flow path pipe 800, and thus, the additive can be supplied to tub 31 or the drawer 38 along with water.

Figure 19:
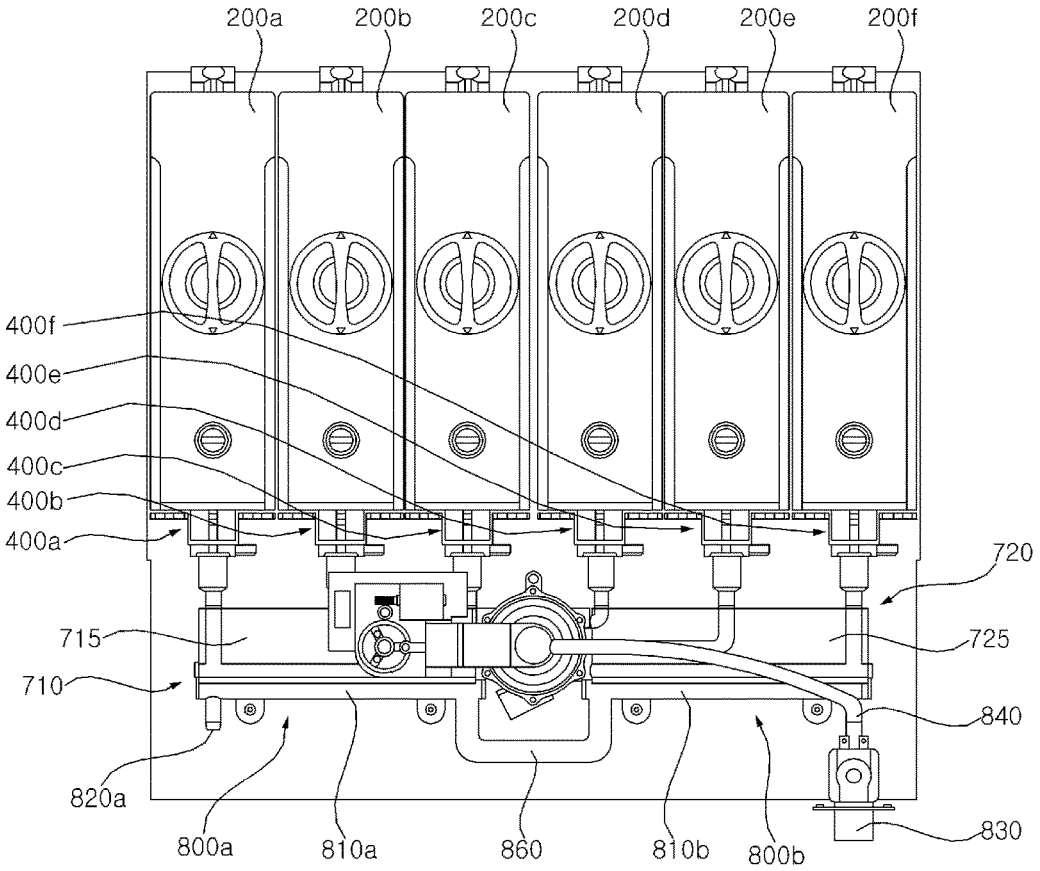
FIG. 19 is a plan view of a washing machine according to another embodiment of the present disclosure.
Figure 21A:
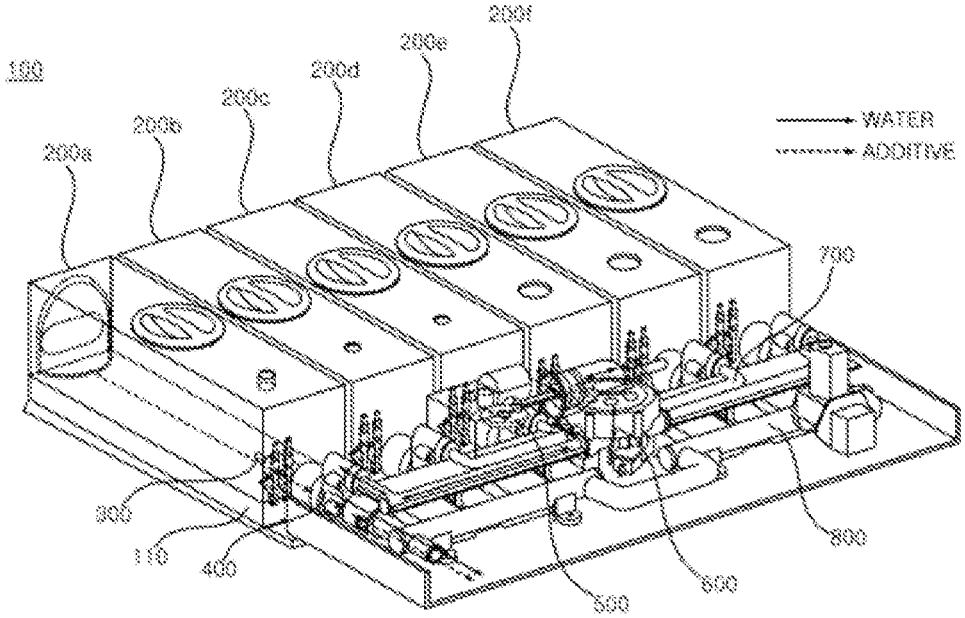
FIGS. 21A and 21B are views showing that water and additive flow according to the pump operation of a washing machine according to another embodiment of the present disclosure.
Figure 21B:
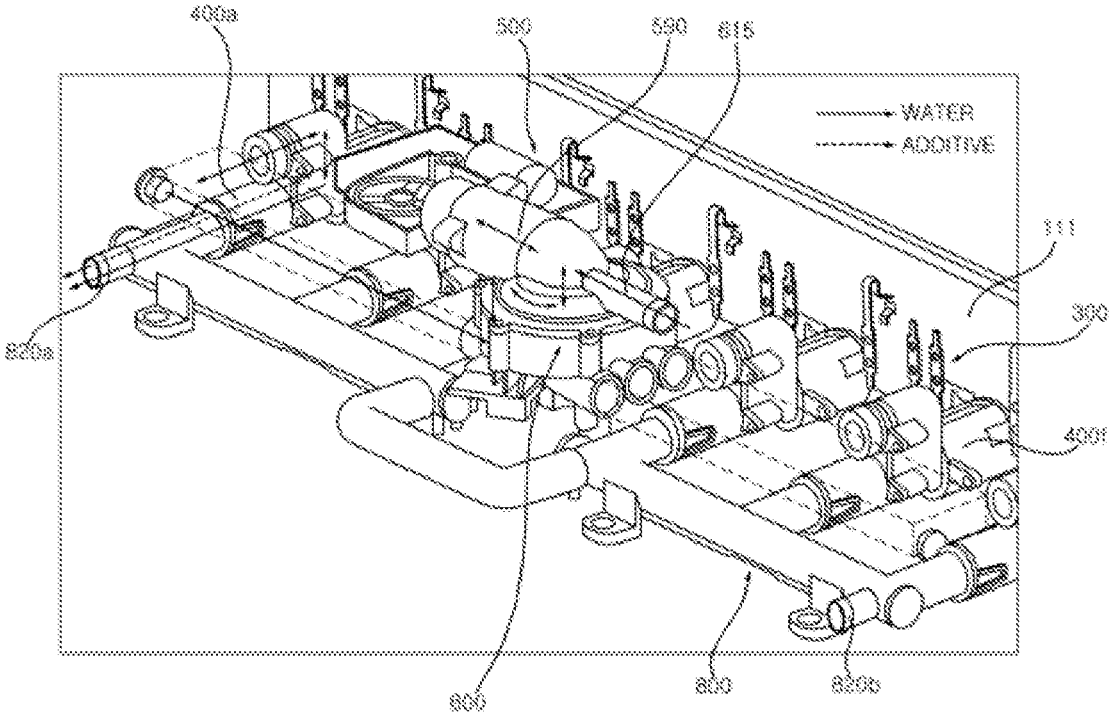

Hereinafter, a water supply valve of a washing machine according to another embodiment of the present disclosure will be described with reference to FIGS. 19, 21A, and 21B.

Unlike the above, the water supply valve 830 of the washing machine according to another embodiment of the present disclosure may be connected to the flow path switching valve 600 or the pump 500, so that water can be supplied to the flow path switching valve 600 or the pump 500. The water supply valve 830 may not supply water directly to the outlet flow path pipe 800, but may supply water to the outlet flow path through the flow path switching valve 600, the inlet flow path 700, and the check valve assembly 400.

A water supply port 615 communicating with the cylinder 590 may be formed in the upper housing 610 of the flow path switching valve 600. The water supply valve 830 is connected to the water supply port 615 formed in the upper housing 610. The water supply valve 830 and the water supply port 615 may be connected by the water supply hose 840.

In this case, the above-described water supply valve 820*b* is not formed in the outlet flow path pipe 800, or the water supply valve 820*b* is sealed by a separate plug or the like.

The washing machine according to another embodiment of the present disclosure uses water as a fluid for driving the first and second check valves 420 and 470. The cylinder 590 and the inlet flow path 700 are filled with water, and water flows through the space S2 formed in the cylinder 590, the inlet flow path 700, and the check valve assembly 400 due to the reciprocating motion of the piston 580. Accordingly, the changed pressure is transmitted to the space S2 formed in the check valve assembly 400.

When the additive to be input is selected, the controller 3 controls the flow path switching valve 600 to communicate the cylinder 590 with the inlet flow path 700 and the check valve assembly 400*a* connected to the cartridge 200*a* containing the selected additive, opens the water supply valve 830 to supply water to the cylinder 590, the flow path switching valve 600, the flow path 700*a*, among the plurality of flow paths of the inlet flow path 700, communicating with the cylinder, and the space S2 of the check valve assembly 400*a*.

After water is supplied, the pump is driven to extract additive from the cartridge 200*a* and discharge the water together with additive to the outlet flow path pipe 800.

Meanwhile, when the water supply valve 830 is opened while the operation of the pump 500 is stopped, water is introduced so that the pressure in the space S2 of the check valve assembly 400*a* communicating with the cylinder 590 increases, and the second check valve 470 is opened, so that water may be discharged to the outlet flow path pipe 800.

Hereinafter, a control method of a washing machine according to an embodiment of the present disclosure will be described with reference to FIG. 22.

The control method of a washing machine according to an embodiment of the present disclosure includes a step S110 of receiving a first signal for the existence of an additive in the outlet flow path pipe 800 through the flow path pipe sensor 900, a step S120 of determining, by the controller 3, whether the first signal is the same as additive no-detection data stored in the memory 4, and a step S210 of extracting the additive when the first signal and the data are the same, and may include a step of outputting a blocking signal of the outlet flow path pipe 800 through the output unit (or the display unit 6) when the first signal and the data are different.

In addition, the control method of the washing machine may include a step S10 of receiving a washing course through the input unit 5, and a step S20 of detecting the amount of laundry accommodated in the washing machine, and may further include a step S240 of supplying water to the outlet flow path pipe 800 through the water supply valve 830 after the step S210 of extracting the additive, a step S250 of receiving a second signal for the existence of an additive inside the outlet flow path pipe 800 through the flow path pipe sensor 900 after the step S240 of supplying water, a step S260 of determining, by the controller 3, whether the second signal and the data are different, a step S280 of outputting a failure signal of the pump 500 through the output unit 6 when the second signal and the data are the same, and a step S300 of performing the received washing course when the second signal and the data are different.

When the washing machine is turned on, the controller 3 may receive a washing course from the user through the input unit 5 (S10).

When the washing course is input, the controller 3 may detect the amount of laundry accommodated in the drum through the current value obtained by rotating the washing motor (S20). The control method for detecting laundry is a known technology and a detailed description thereof will be omitted.

The controller 3 drives the flow path switching valve 600 to communicate the pump 500 with the check valve assembly 400*a* connected to the cartridge containing a preset additive according to the input washing course (S30). The memory 4 stores information related to additive to be added according to the washing course, and the controller 3 may select additive to be added according to the input washing course. The additive contained in the cartridge 200 can be determined by analyzing the current input through the cartridge sensor 300, and comparing with the data for each additive stored in the memory 4.

After communicating the check valve assembly 400*a* with the pump 500, the controller 3 may calculate the amount of the additive to be discharged according to the input washing course and the detected laundry amount (S40). Unlike this, the controller 3 may detect the amount of laundry (S20), calculate the amount of the additive to be discharged (S40), and then drive the flow path switching valve 600 (S30). Alternatively, the driving of the flow path switching valve 600 (S30) and the calculation of the amount of additive to be discharged (S40) may be performed simultaneously.

Meanwhile, the controller 3 receives a first signal for the existence of an additive in the outlet flow path pipe 800 through the flow path pipe sensor 900 (S110). The first signal and the second signal may be an electrical signal such as current value or voltage value.

After receiving the first signal, the controller 3 determines whether it is the same as the additive no-detection data previously stored in the memory 4 (S120). The additive no-detection data is a signal generated from the flow path pipe sensor 900 when the outlet flow path pipe 800 is empty or filled with water, and may be previously stored in the memory 4 by the designer in the manufacturing process of the washing machine.

The additive no-detection data may be any one value, or may be stored in a certain numerical range in order to enhance the accuracy of detection.

When the first signal is the same as the data, the controller 3 may determine that the outlet flow path pipe 800 is in a normal state without clogging (S130), and may output an outlet flow path pipe normal signal through the output unit.

When the first signal is different from the above data, it means a case where the additive remains in the outlet flow path pipe 800. Therefore, the controller 3 determines that the outlet flow path pipe 800 is blocked, and may output a failure signal of the outlet flow path pipe 800 through the output unit 6 (S140).

Figure 22:
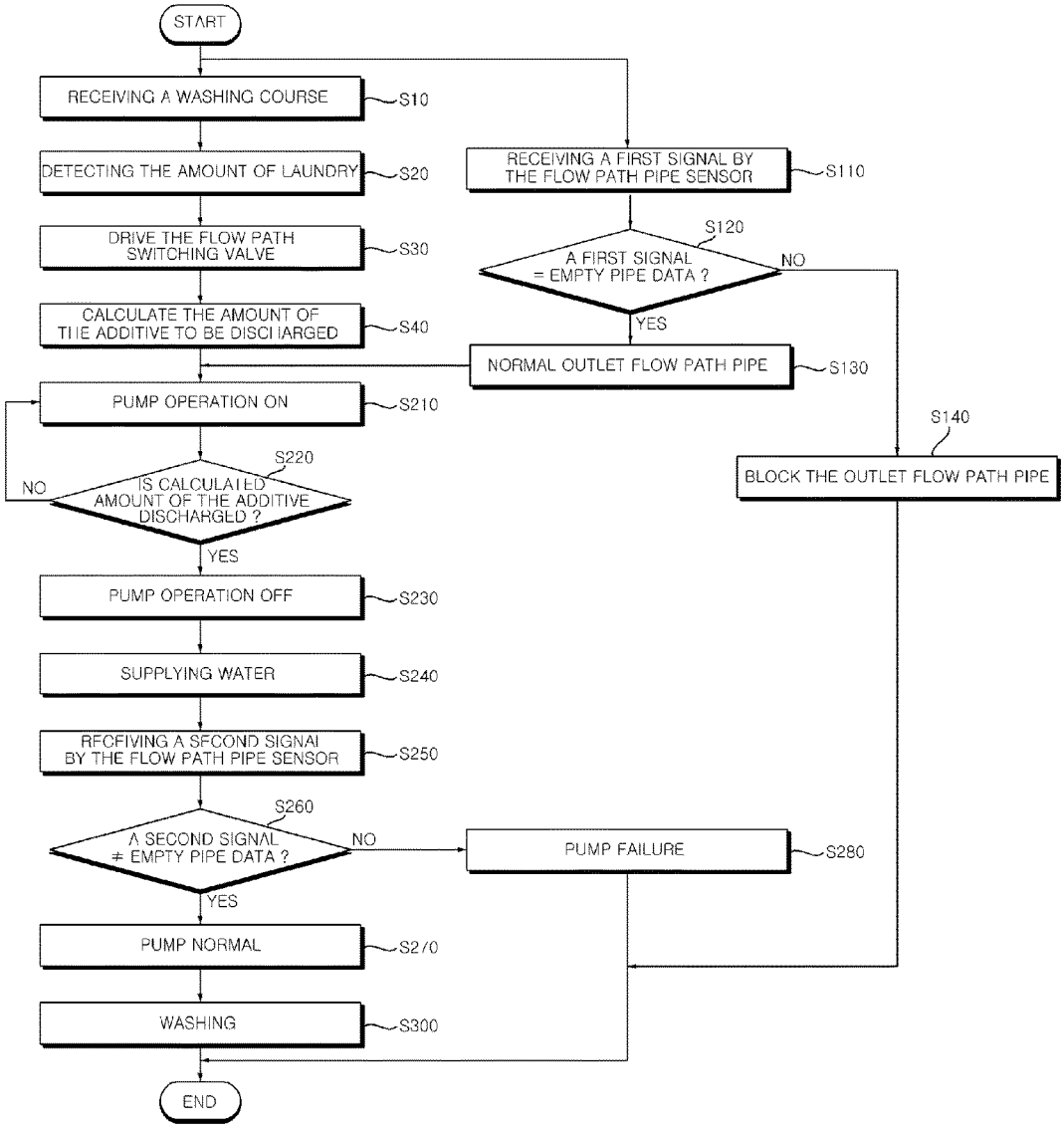
FIG. 22 is a flowchart showing a control method of a washing machine according to an embodiment of the present disclosure.

Referring to FIG. 22, steps S10 to S40 and steps S110 to S140 may be performed without temporal sequential relationship with each other.

When it is determined that the outlet flow path pipe is in a normal state (S130), and the amount of the additive to be discharged is calculated (S40), then, the controller 3 may operate the pump 500 to extract the additive (S210).

Depending on the washing course and the amount of laundry, the amount of the additive to be added to the tub 31 may be stored in the memory 4, and the amount of the additive to be added may be stored as time data for driving the pump 500.

When all of the calculated amount of the additive is discharged (S220), the controller 3 may stop the operation of the pump 500.

After stopping the operation of the pump, the controller 3 opens the water supply valve 830 to supply water to the outlet flow path pipe 800 (S240), and may receive a second signal for the existence of an additive in the outlet flow path pipe through the flow path pipe sensor 900 (S250).

After receiving the second signal, the controller 3 determines whether it is different from the additive no-detection data stored in the memory 4 (S260).

When the second signal is different from the data, the controller 3 may determine as a normal state in which the pump 500 operates normally and the additive is extracted to the outlet flow path pipe 800 (S270), and may output a pump normal signal through the output unit.

When the second signal is the same as the data, it means the case where the additive is not detected in the outlet flow path pipe 800, the controller 3 determines that there is a problem in the operation of the pump 500 and may output a failure signal of the pump 500 through the output unit 6 (S280).

When it is determined that the pump 500 is in a normal state (S270), the controller 3 may perform the input washing course.

According to the washing machine of the present disclosure, there are one or more of the following effects.

First, the washing machine of the present disclosure includes a flow path pipe sensor installed in the outlet flow path pipe for supplying liquid additive such as detergent to the tub, thereby detecting the existence of the additive in the outlet flow path pipe.

Second, before extracting the additive from the cartridge, it is possible to detect whether the additive remains in the outlet flow path, thereby detecting the blocking of the outlet flow path. Accordingly, there is an advantage of preventing the washing course from proceeding without introducing the additive into the tub.

Third, it is possible to detect whether the additive remains in the outlet flow path pipe through the flow path pipe sensor. Furthermore, the water supply valve supplies water to the outlet flow path pipe through which the additive flows, thereby preventing the outlet flow path from being blocked as the additive is solidified.

Fourth, after the instruction of the pump operation, it is possible to detect whether the pump is operating normally by detecting the existence of an additive in the outlet flow path pipe through the flow path pipe sensor.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing machine comprising:

a tub configured to receive water;

a drum rotatably provided inside the tub and configured to accommodate laundry therein;

a detergent supply device that configured to supply a liquid additive to the tub;

a controller that is configured to control the detergent supply device, wherein the detergent supply device comprises:

a plurality of cartridges that are each configured to contain the liquid additive, a pump configured to extract the liquid additive contained in the plurality of cartridges, an outlet flow path pipe that is connected to the plurality of cartridges and that is configured to guide the extracted additive toward the tub, and an electrode sensor located in the outlet flow path pipe and configured to detect a presence of the liquid additive in the outlet flow path pipe, wherein the controller is configured to control the pump based on an electric signal from the electrode sensor, wherein the outlet flow path pipe comprises:

a plurality of inflow ports respectively connected to the plurality of cartridges to receive the liquid additive from the plurality of cartridges, a joint pipe connected to the plurality of cartridges to receive the liquid additive that flows through the plurality of inflow ports, and a discharge port that is in fluid communication with the joint pipe and that is configured to discharge the liquid additive received from the joint pipe toward the tub, and wherein the electrode sensor is configured to be disposed in the joint pipe.

2. The washing machine of claim 1, wherein the electrode sensor comprises a rod electrode located in a flow path inside the outlet flow path pipe.

3. The washing machine of claim 2, wherein the rod electrode is extended along a direction of the flow path inside the outlet flow path pipe.

4. The washing machine of claim 3, wherein the electrode sensor comprises an electrode terminal that protrudes at a predefined angle from the rod electrode and that protrudes toward an outside of the outlet flow path pipe.

5. The washing machine of claim 2, wherein the rod electrode is located in a lower portion of the flow path inside the outlet flow path pipe.

6. The washing machine of claim 1, wherein the detergent supply device comprises a water supply valve that is configured to receive water from an external water source and to supply the received water to the outlet flow path pipe, and wherein the outlet flow path pipe comprises a water supply port connected to the water supply valve and configured to receive the water from the water supply valve.

7. The washing machine of claim 1, wherein the joint pipe defines a straight flow path therein.

8. The washing machine of claim 1, wherein the outlet flow path pipe comprises:

a first outlet flow path pipe that includes a portion of the plurality of inflow ports, the discharge port, and a first joint pipe, the first joint pipe being configured to guide the liquid additive received from the portion of the plurality of inflow ports to the discharge port, a second outlet flow path pipe that includes a remaining portion of the plurality of inflow ports and a second joint pipe, the second joint pipe being configured to receive the liquid additive from the remaining portion of the plurality of inflow ports, and a connection hose that connects the first outlet flow path pipe and the second outlet flow path pipe, and wherein the electrode sensor comprises a first sensor located at the first joint pipe, and a second sensor located at the second joint pipe.

9. The washing machine of claim 8, wherein the first outlet flow path pipe and the second outlet flow path pipe are spaced apart from each other in a direction along which the plurality of cartridges are arranged.

10. The washing machine of claim 9, wherein the detergent supply device comprises:

a plurality of check valve assemblies that are connected to the plurality of cartridges and configured to control the extraction of the liquid additive, each of the plurality of check valves assemblies defining a space therein configured to temporarily store the extracted additive, an inlet flow path that includes a plurality of flow paths respectively in fluid communication with the space formed in the plurality of check valve assemblies, and a flow path switching valve configured to selectively establish fluid communication between the pump and one of the plurality of flow paths of the inlet flow path, and wherein the flow path switching valve is located between the first outlet flow path pipe and the second outlet flow path pipe.

11. The washing machine of claim 10, wherein the first sensor comprises:

a pair of first rod electrodes located in an inner flow path of the first joint pipe, and a pair of first electrode terminals that are bent from the pair of first rod electrodes and that protrude toward outside of the first joint pipe, wherein the second sensor comprises:

a pair of second rod electrodes located in an inner flow path of the second joint pipe, and a pair of second electrode terminals that are bent from the pair of second rod electrodes and that protrude toward outside of the second joint pipe, wherein the first electrode terminal comprises a bent portion at an end of the first rod electrode that is positioned closer to the second outlet flow path pipe, and wherein the second electrode terminal comprises a bent portion at an end of the second rod electrode that is positioned closer to the first outlet flow path pipe.

12. The washing machine of claim 1, wherein the controller is configured to:

operate the pump to extract the liquid additive from one or more of the plurality of cartridges into the outlet flow path pipe based on a first signal received from the electrode sensor for detecting a presence of the liquid additive in the outlet flow path pipe.

13. The washing machine of claim 12, further comprising a memory with pre-stored an additive no-detection data which is related to a signal received from the electrode sensor based on the liquid additive not being received in the outlet flow path pipe, and wherein the controller is configured to:

operate the pump to extract the liquid additive from the one or more of the plurality of cartridges into the outlet flow path pipe based on the first signal matching the additive no-detection data.

14. The washing machine of claim 13, further comprising an output unit configured to output a blocking signal, wherein the controller is configured to:

output a blocking signal by the output unit based on the first signal not matching the additive no-detection data.

15. The washing machine of claim 14, further comprising a water supply valve that is configured to receive water from an external water source and to supply the received water to the outlet flow path pipe, wherein the controller is further configured to supply water to the outlet flow path pipe through the water supply valve after operating the pump.

16. The washing machine of claim 15, wherein the controller is further configured to output a failure signal of the pump through the output unit based on a second signal not matching the additive no-detection data, the second signal received from the electrode sensor for detecting, after supplying water, a presence of the liquid additive in the outlet flow path pipe.

* * * * *